United States Patent [19]

Ikenoue et al.

[11] Patent Number: 5,075,786

[45] Date of Patent: Dec. 24, 1991

[54] PRINTER APPARATUS WITH SHEET SUPPLY SELECTING MEANS

[75] Inventors: Yoshikazu Ikenoue; Yukio Tadauchi; Takashi Morikawa, all of Osaka, Japan

[73] Assignee: Minolta Camera Kabushiki Kaisha, Osaka, Japan

[21] Appl. No.: 525,297

[22] Filed: May 17, 1990

Related U.S. Application Data

[63] Continuation of Ser. No. 181,691, Apr. 14, 1988, abandoned.

[30] Foreign Application Priority Data

Apr. 15, 1987 [JP] Japan ..... 62-92193
Jun. 27, 1987 [JP] Japan ..... 62-160377

[51] Int. Cl.[5] ..... G03G 21/00; H04N 1/00; H04N 1/32

[52] U.S. Cl. ..... 358/449; 355/311

[58] Field of Search ..... 355/206, 208, 308, 309, 355/311; 358/449

[56] References Cited

U.S. PATENT DOCUMENTS

| | | | |
|---|---|---|---|
| 3,806,242 | 4/1974 | Reehil | 355/308 |
| 4,008,957 | 2/1977 | Summers | 355/311 |
| 4,090,787 | 5/1978 | Hubbard et al. | 355/314 |
| 4,099,860 | 7/1978 | Connin | 355/314 |
| 4,190,246 | 2/1980 | Sasuga | 355/311 X |
| 4,222,660 | 9/1980 | Furuichi et al. | 355/311 |
| 4,302,098 | 11/1981 | Kan et al. | 355/311 X |
| 4,383,756 | 5/1983 | Hanamoto et al. | 355/314 |
| 4,386,769 | 6/1983 | Ito et al. | 271/9 |
| 4,439,790 | 3/1984 | Yoshida | 358/449 |
| 4,440,487 | 4/1984 | Miura | 355/311 |
| 4,685,797 | 8/1987 | Ito | 355/313 |
| 4,693,459 | 9/1987 | Shimoda et al. | 355/311 X |
| 4,796,056 | 1/1989 | Ito | 355/311 X |
| 4,956,723 | 9/1990 | Toda | 358/449 |

FOREIGN PATENT DOCUMENTS

| | | | |
|---|---|---|---|
| 51866 | 5/1982 | European Pat. Off. | 358/449 |
| 60-72763 | 4/1985 | Japan . | |

*Primary Examiner*—Fred L. Braun

*Attorney, Agent, or Firm*—Burns, Doane, Swecker & Mathis

[57] ABSTRACT

An image forming apparatus including a mechanism for forming a visual image on a sheet of paper and a plurality of sheets supply mechanisms each including a sheet storage cassette detachably incorporated therein. A detector for detecting the attaching operation of the sheet storage cassettes in each of the sheets supply mechanisms is also provided. An automatic selecting circuit, which is responsive to the detector, automatically selects the sheets supply mechanisms for which the attaching operation has been detected by the detector. A signal is generated to disable the automatic selecting circuit. The disabling signal enables operation without a cassette attached to the sheets supply mechanism irrespective of the sheet size selected.

13 Claims, 23 Drawing Sheets

30
32
34
36
38a
38b
38c
62
64
66
68
70
72
74
76
78
80
82
84
86a
86b
86c
88a
88b
88c
90
92
94
96
98
100
102
104
106
110a
110b
110c
ScPa
SPFa
SPAa
ScPb
SPFb
SPAb
ScPc
SPFc
SPAc
A

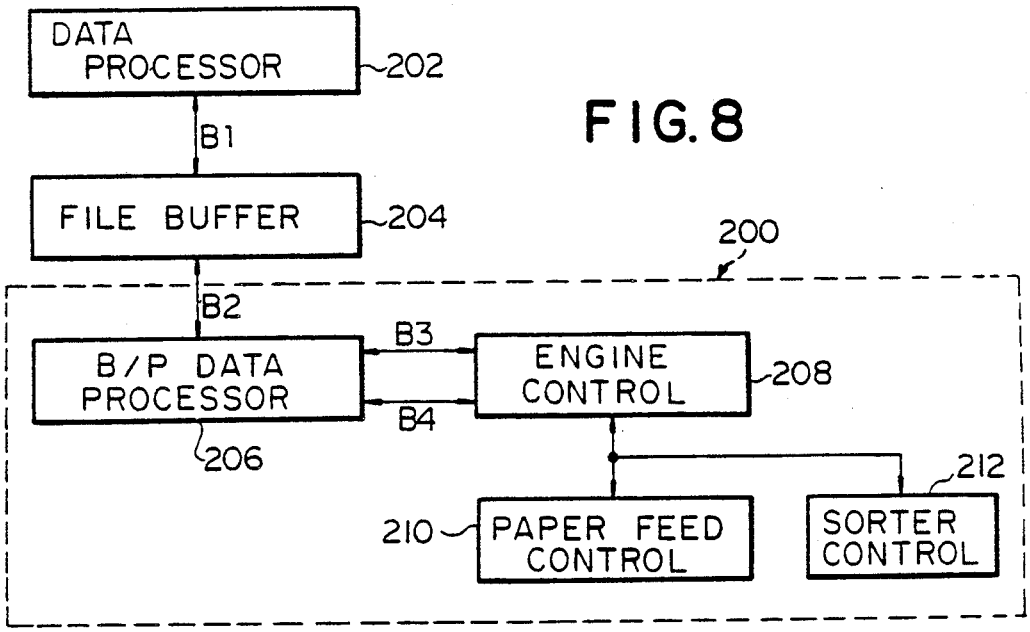
FIG. 8
FIG. 9
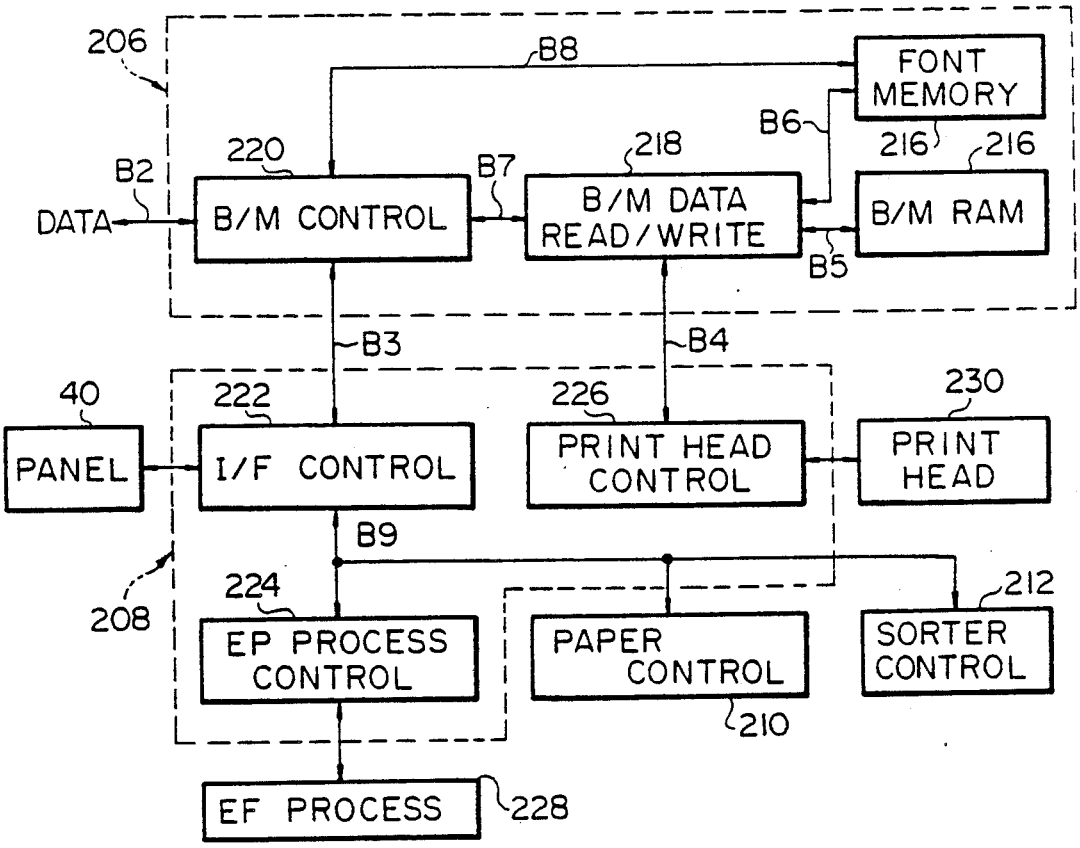

PRINTER APPARATUS WITH SHEET SUPPLY SELECTING MEANS

This application is a continuation of application Ser. No. 181,691, filed Apr. 14, 1988, now abandoned.

FIELD OF THE INVENTION

The present invention relates to a printer apparatus which may form part of or may be incorporated into a computer or a word processor. More particularly, the present invention relates to a printer apparatus having a plurality of sheet supply stages each including a sheet storage cassette for storing a stack sheets therein.

BACKGROUND OF THE INVENTION

Before a printer apparatus coupled with a computer or a word processor is initiated into operation, it is necessary to detect the presence or absence of print sheet storage cassette, and print sheets in each of the cassettes. Such detection is made immediately after the printer apparatus is initially switched on, and after a new sheet storage cassette is selected. For this purpose, a particular order of priority is allocated to the sheet supply stages so that the individual sheet supply stages are successively checked in a sequence complying with such an order of priority.

In a known printer apparatus of the described type, the presence or absence of a print sheet stored in each of the sheet storage cassettes coupled to the sheet supply stages is detected with use of a mechanism by means of which a stock of print sheets stored in the sheet storage cassette of each of the sheet supply stages is to be elevated within the cassette. With the stock of print sheets thus elevated in the cassette, a detector lever which forms part of a detector assembly is actuated by the uppermost one of the print sheets within the sheet storage cassette to produce a suitable form of signal to indicate the presence of a print sheet in the cassette. If the presence or absence of the print sheets in the sheet storage cassette is detected from the signal produced before the stock of the print sheets is elevated to a predetermined height with respect to the detector lever, it is likely that the sheet storage cassette be determined to have no print sheet stored therein.

Where the printer apparatus is of the type having a plurality of sheet supply stages each including a sheet storage cassette, the detection of the presence or absence of print sheets in each the sheet storage cassettes is performed successively for the individual sheet supply stages in a sequence which complies with an order of priority predetermined for the sheet supply stages as discussed above. If the presence or absence of the print sheets in any of the sheet storage cassettes in such a printer apparatus is detected from a signal produced before the stock of the print sheets is elevated to the predetermined height, it is more likely that the sheet storage cassette be determined to have no print sheet stored therein although there is actually a stock of print sheets stored therein.

The present invention contemplates provision of a printer apparatus which will eliminate the problem which has thus far been inherent in a printer apparatus of the described type.

SUMMARY OF THE INVENTION

In accordance with the present invention, there is provided a printer apparatus comprising a) image forming means for forming a visible image on a sheet medium, b) a plurality of sheet supply means each comprising a sheet storage cassette detachably incorporated therein, c) data supply means for supplying data including image data relating to the image to be formed by the image forming means and control data designating one of the sheet supply means, d) detecting means for detecting the presence or absence of the sheet storage cassette in each of the sheet supply means, e) first selecting means responsive to information from the detecting means for selecting the sheet supply means the presence of which has been detected by the detecting means, f) second selecting means responsive to the control data for selecting the sheet supply means designated by the control data, and g) control means for prohibiting operation of the first selecting means after any of the sheet supply means has been selected by the second selecting means.

BRIEF DESCRIPTION OF THE DRAWINGS

The features and advantages of a printer apparatus according to the present invention will be more clearly understood from the following description taken in conjunction with the accompanying drawings in which:

FIG. 8 is a diagram showing the general arrangement of a printer control system which forms part of a printer apparatus embodying the present invention as coupled with a standard data processor unit;

FIG. 9 is a block diagram showing the detailed configurations of preferred example of the data processing and print engine control networks incorporated in the printer control system illustrated in FIG. 8;

DESCRIPTION OF THE PREFERRED EMBODIMENT

Figure 1:
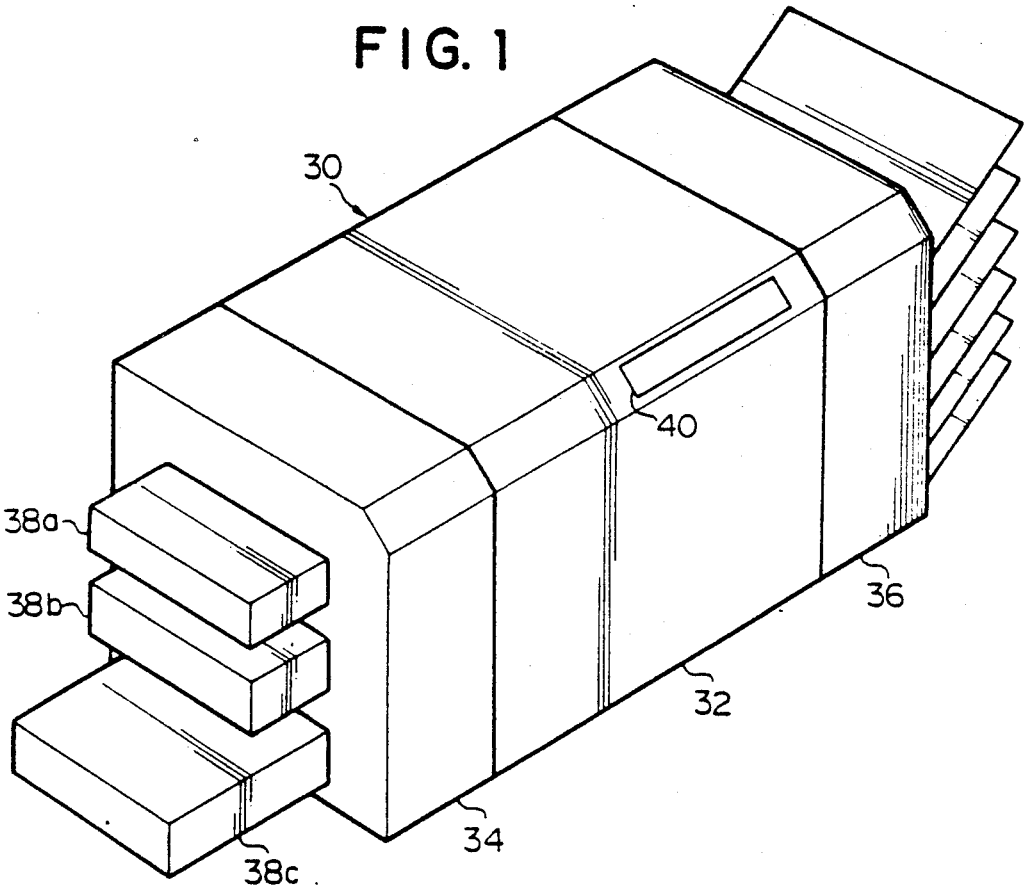
FIG. 1 is a schematic perspective view showing an example of a printer apparatus to which the present invention pertains.

In FIG. 1 is shown an example of a printer apparatus 30 embodying the present invention may be incorporated. The printer apparatus 30 is assumed to be of the bit-map controlled laser type and, as shown, largely consists of a print engine module 32 which may be implemented by a known electrophotographic image reproducing system provided with a sheet supply module 34 and a print output module 36. The sheet supply module 34 implements a record medium supply unit similar to that used in an ordinary image duplicating apparatus, and the print output module 36 is shown represented by a printed output sorter. The sheet supply module 34 implementing the record medium supply unit is shown to be of the type using detachable paper storage cassettes which are shown including upper, intermediate and lower sheet storage cassettes 38*a*, 38*b* and 38*c* by way of example. The printer apparatus 30 thus composed of the print engine module 32, sheet supply module 34 and print output module 36 has provided on the print engine module 32 a control panel 40 which may be configured as illustrated in FIG. 2.

Figure 2:
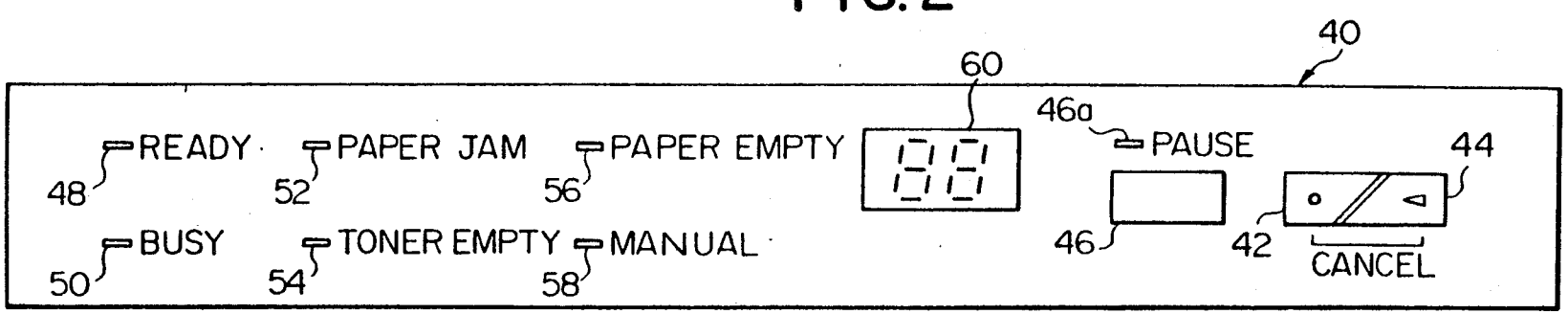
FIG. 2 is a plan view showing an example of the configuration of a control panel which may form part of the printer apparatus illustrated in FIG. 1.

Referring to FIG. 2, the control panel 40 of the printer apparatus 30 herein under consideration comprises switches which include a test print start switch 42, a shift switch 44 and a print pause switch 46. The test print start switch 42 is used to start test print operation when the switch 42 alone is depressed. When the test print start switch 42 is depressed with the shift switch 44 depressed concurrently, the test print operation which has once been started is interrupted or a request for such operation is cancelled. The test print operation once started can also be interrupted with the print pause switch 46 depressed after the test print start switch 42 is depressed. When the print pause switch 46 is depressed, an associated indicator 46*a* is turned on to illuminate. On the control panel 40 are further provided indicators which include an indicator 46 to indicate that the apparatus 30 is in a condition ready for printing operation, an indicator 50 to indicate that the apparatus 30 is busy printing, and an indicator 52 to indicate the jamming of copy paper within apparatus 30 during printing operation. The indicators on the control panel 40 further include an indicator 54 to indicate that there is no storage of developer agent such as toner in the apparatus 30, an indicator 56 to indicate that there is no record medium such as copy paper in any of the paper storage cassettes 38*a*, 38*b* and 38*c*, and an indicator 58 to indicate that a manual paper supply mode is established in the printer apparatus 30. Each of these indicators 46*a* and 48 to 58 may be implemented by a light emitting diode (LED). On the control panel 40 is further provided a seven-segment type numerical display window 60 for indicating the selected number of prints to be output for a single printing operation. The configuration of the control panel 40 shown here is simply for purposes of illustration and is not limitative of the functions available in a printer apparatus according to the present invention is applicable.

Figure 3:
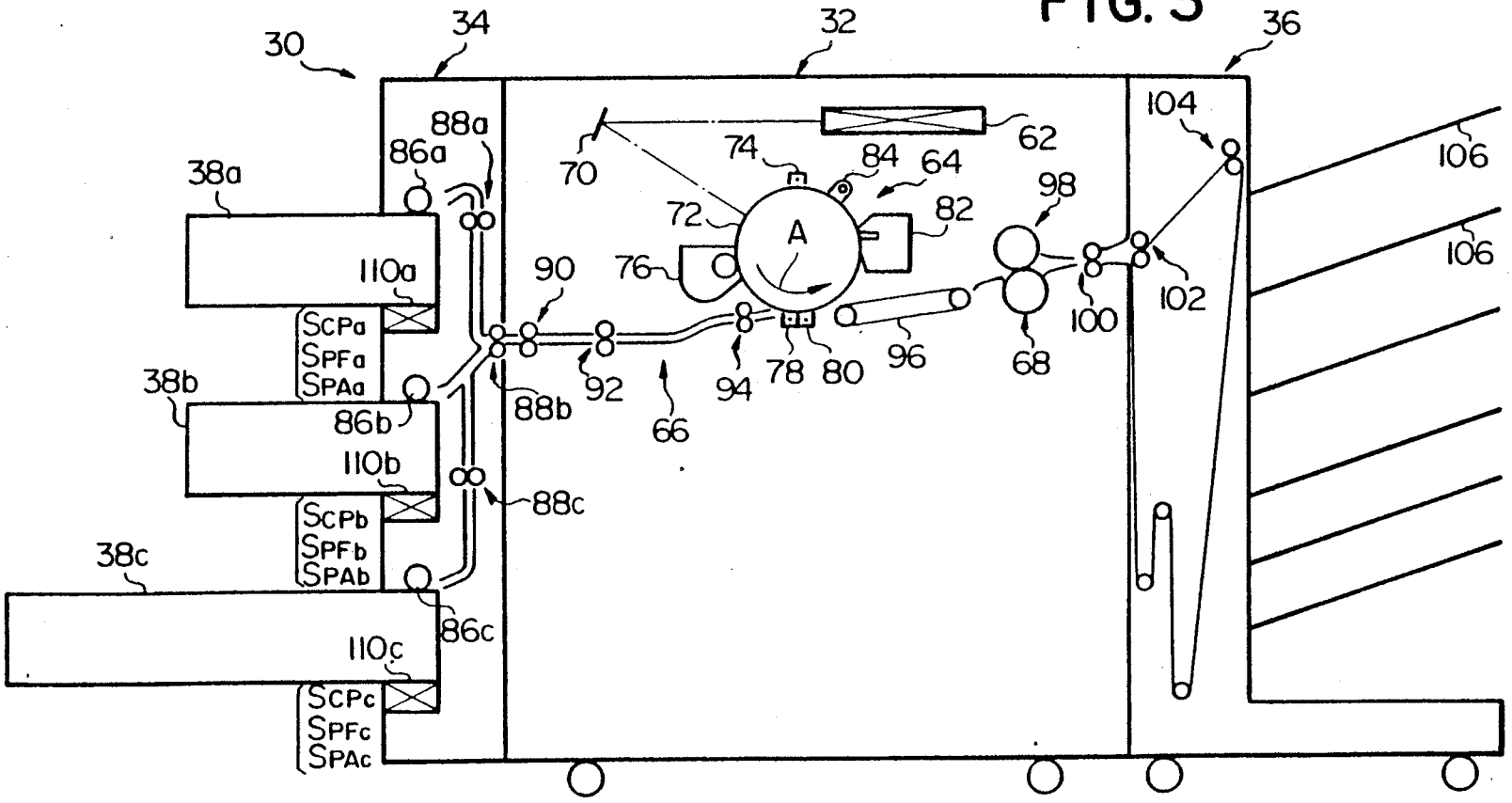
FIG. 3 is a schematic sectional view showing part of the mechanical construction and arrangement of the printer apparatus apparatus illustrated in FIG. 1.

FIG. 3 schematically shows part of the mechanical construction and arrangement of the print engine module 32 which forms part of the printer apparatus 30 embodying the present invention. As shown, the printer apparatus 30 comprises an optical scanning assembly 62, an image reproducing assembly 64, a paper feed mechanism 66 and an image fixing assembly 68. The optical scanning assembly 62 emits a beam of light, which is incident on and reflected from a projecting mirror 70. The image reproducing assembly 64 comprises a cylindrical image transfer drum 72 having a conductive peripheral surface layer coated with a photoconductive substance. The light incident reflected from the projecting mirror 70 is directed toward this image transfer drum 72 and is focused onto the peripheral surface of the drum 72. The image transfer drum 72 is driven for rotation in a direction indicated by arrow a by appropriate drive means (not shown). The image reproducing assembly 64 further comprises a main charger 74 to sensitize the photoconductive peripheral surface of the image transfer drum 72 by applying electrostatic charges uniformly to the surface of the drum 72. These charges are dissipated in areas exposed to light and electrostatic latent images are created by the charges remaining on the drum 72 upon irradiation with light from the mirror 70. Posterior to the path of light to the drum 72 is located an image developing assembly 76 having a stock of toner particles to be applied to the photoconductive peripheral surface of the image transfer drum 72. Visible toner images are thus produced conformingly to the latent images on the drum 72.

Posterior to the image developing assembly 76 in the direction of rotation a of the drum 72 is provided an image transfer charger 78 which is operative to charge the print sheet so that the toner images on the image transfer drum 72 are transferred to the print sheet supplied from the sheet supply module 34. The print sheet thus having the toner images carried thereon is cleared of charges by a separation charger 80 located posterior to the image transfer charger 78. There is further provided a drum cleaner assembly 82 which removes any residual toner particles from the peripheral surface of the drum 72. Posterior to this cleaner assembly 82 in turn is positioned a charge eraser lamp 52 which irradiates the cleaned peripheral surface of the drum 72 to eliminate the charges which may be left thereon. Though not shown, each of the chargers 74, 78 and 80, developing and cleaner units 76 and 82 and eraser lamp 84 includes or is associated with appropriate drive or actuator means.

The paper feed mechanism 66 is provided in conjunction with the upper, intermediate and lower paper storage cassettes 38*a*, 38*b* and 38*c* which are detachably fitted to the sheet supply module 34 and which have stocks of print sheets of different sizes encased therein. Such a paper feed mechanism 66 comprises paper feed rollers 86*a*, 86*b* and 86*c* associated with the upper, intermediate and lower paper storage cassettes 38*a*, 38*b* and 38*c*, respectively, each of which is driven for rotation to pick up print sheets one after another from the stock of print sheets P in the associated cassette. Past the paper feed rollers 86*a* and 86*c* associated with the upper and lower sheet storage cassettes 38*a* and 38*c* are provided a pair of guide rollers 88*a* and a pair of guide rollers 88*c*, respectively. Similarly, a pair of intermediate guide rollers 88*b* is provided past the paper feed roller 86*b* and 86*c* associated with the intermediate sheet storage cassette 38*b*. A print sheet picked up from the upper sheet storage cassette 38*a* by the paper feed roller 86*a* is guided downwardly to the intermediate guide roller pair 88*b* by means of the upper guide roller pair 88*a*. Likewise, a print sheet picked up from the lower sheet storage cassette 38*c* by the paper feed roller 86*c* is guided upwardly to the intermediate guide roller pair 88*b* by means of the lower guide roller pair 88*c*. A print sheet picked up from the intermediate sheet storage cassette 38*b* by the paper feed roller 86*b* is passed directly to the intermediate guide roller pair 88*b*. The print sheet thus passed directly or by way of the upper or lower guide roller pair 88*a* or 88*c* to the intermediate guide roller pair 88*b* is further guide to travel toward the image transfer drum 72 through a series of roller pairs 90 and 92.

Though not shown, each of the paper feed rollers 86*a*, 86*b* and 86*c* is operatively coupled to suitable drive means through suitable actuator means such as a solenoid-operated clutch. Posterior to the developing assembly 76 in the direction of rotation a of the image transfer drum 72 is provided a pair of timing rollers 94 which are located posterior to the guide roller pair 92 in the direction of travel of a print sheet. The print sheet passed from the guide roller pair 92 is passed through the timing roller pair 94 to the image transfer drum 72.

The paper feed mechanism 66 further comprises a copy-sheet transport belt assembly 96 positioned posterior to the area where a printed sheet is to be separated from the image transfer drum 72. The transport belt assembly 96 comprises spaced driven and idler rollers and an endless transport belt passed between the rollers and transports the printed sheet toward the image fixing assembly 68. The image fixing assembly 68 is provided at the rear of the transport belt assembly 96 and comprises a pair of heater rollers 98 arranged to form therebetween a nip aligned with the path of travel of a print sheet from the belt assembly 96. The print sheet transported on the transport belt assembly 96 is thus nipped between the heater rollers 82 so that the toner particles carried on the sheet are thermally fused and the toner images are fixed on the print sheet. The print sheet released from the rollers 82 is guide by a roller pair 100 and is withdrawn from the print engine module 32 to the print output module 36 through a paper discharge roller pair 102. The print output module 36 comprises various guide rollers including a pair of sorting rollers 104 which is movable vertically for being operable for delivering a supplied print sheet to any of a plurality of paper collect trays 106 which are vertically arranged in a stack.

On the other hand, the sheet supply module 34 of the apparatus embodying the present invention comprises cassette sensor arrangements 110*a*, 110*b* and 110*c* provided in association with the upper, intermediate and lower sheet storage cassettes 38*a*, 38*b* and 38*c*, respectively. These sheet storage cassettes 38*a*, 38*b* and 38*c* being similar in construction and arrangement. the mechanical construction and arrangement of one of the detector assemblies will be described with reference to FIGS. 4, 5 and 6.

Figure 4:
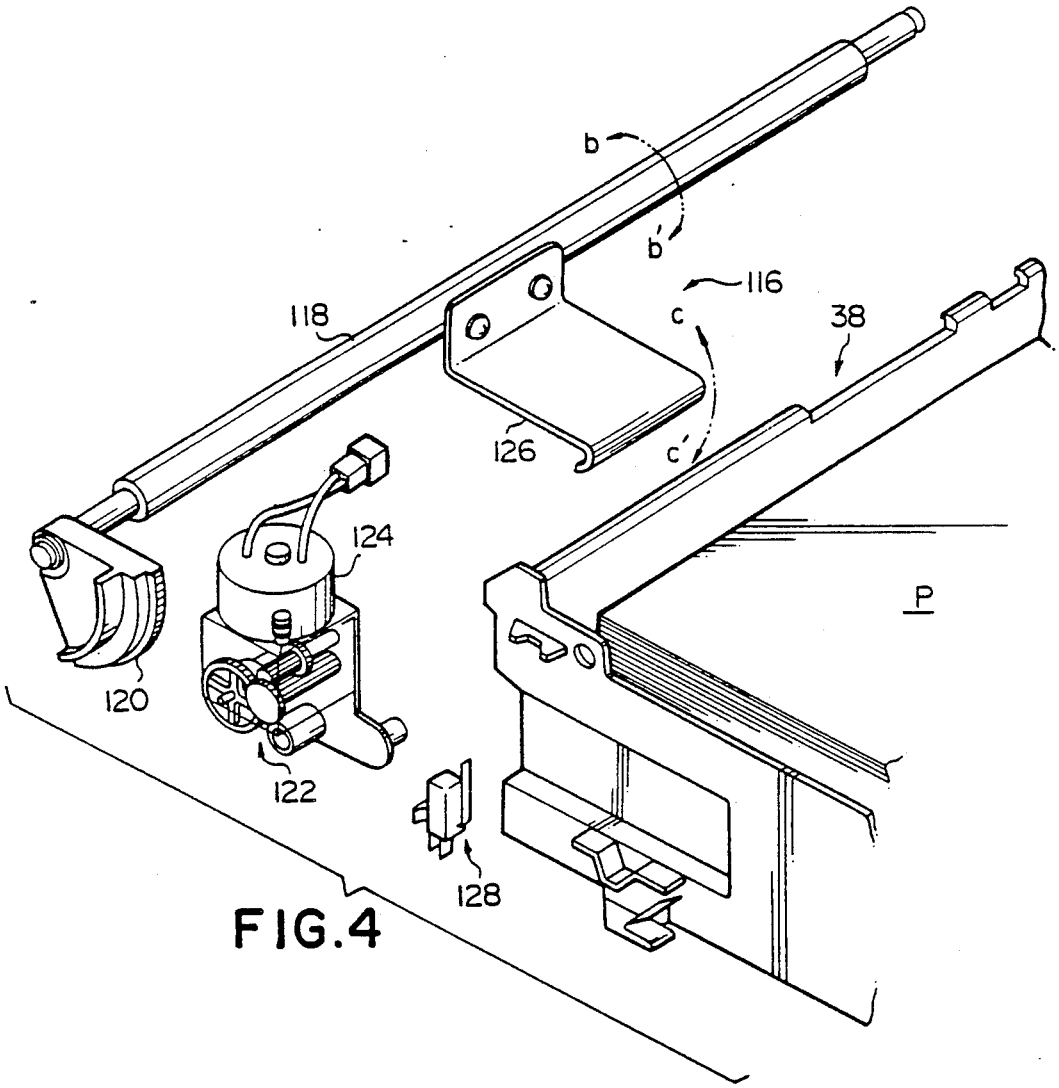
FIG. 4 is a fragmentary, exploded perspective view showing a paper elevating mechanism provided in conjunction with each of the sheet storage cassettes assembled to a sheet supply module in the printer apparatus illustrated in FIG. 1.
Figure 5:
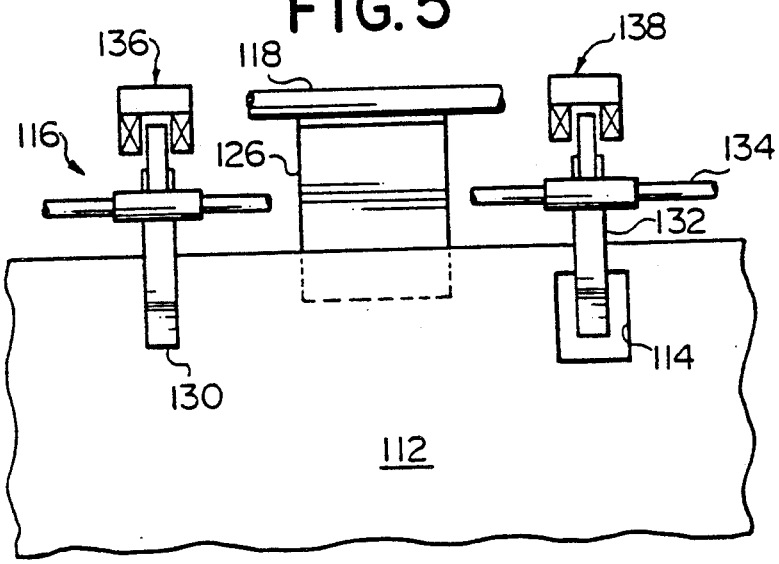
FIG. 5 is a fragmentary plan view schematically showing part of the paper elevating mechanism illustrated in FIG. 4 and part of the cassette sensor arrangement provided in conjunction with each of the sheet storage cassettes in association with the paper elevating mechanism.

Referring to FIG. 4, the sheet storage cassette, represented by reference numeral 38, is shown storing a stock of print sheets P received on a paper support plate 112 (FIG. 5) which forms part of the cassette 38. The paper support plate 112 is assumed to be arranged to be vertically movable in its entirety within the cassette 38 although the support plate 112 may be arranged to be rockable about an axis fixed in the cassette 38 at or in the neighborhood of the rear end of the plate 112. Such a paper support plate 112 is formed with a slot 114 located in a front end portion of the support plate 112 for the reason which will be understood as the description proceeds.

The cassette sensor arrangement 110 for the sheet storage cassette 38 as above described is provided in conjunction with a paper elevating mechanism 116 adapted to raise the paper support plate 112 of the sheet storage cassette 38 and the stock of print sheets P upwardly within the cassette 38. Such a paper elevating mechanism 116 comprises an elongated shaft 118 extending in a direction perpendicular in non-intersecting relationship to the direction in which a print sheet P is to be picked up from the sheet storage cassette 38. The shaft 118 is journalled at two axial locations thereof to the housing of the sheet supply module 34 though not shown in the drawings and is thus rotatable about the center axis thereof with respect to the sheet storage cassette 38 either counterclockwise as indicated by arrow b or clockwise as indicated by arrow b'. The shaft 118 has fixedly carried thereon a sector gear 120 which is held in mesh with an output gear element of a driving gear assembly 122. The driving gear assembly 122 further includes an input gear element coupled to or otherwise appropriately engaged by the output shaft of a reversible motor 124. To an intermediate portion of the shaft 118 is fixedly cantilevered a lever plate 126 which is rockable about the center axis of the shaft 118 in directions of arrows c and c' as the shaft 118 turns in the directions of the arrows b and b', respectively. The lever plate 126 is engageable at its leading end with the bottom face of the paper support plate 112 of the sheet storage cassette 38 so that the paper support plate 112 and the stock of print sheets P when stored in the cassette 38 are caused to move upwardly as the lever plate 126 is caused to turn in the direction of the arrow c or are allowed to lower as the lever plate 126 is caused to turn in the direction of the arrow c'. Indicated by reference numeral 128 in conjunction with the sheet storage cassette 38 is a cassette sensor which is adapted to detect the presence or absence of the sheet storage cassette 38 assembled to the sheet supply module 34 for producing a signal $S_{CP}$ of logic "1" state in the presence of the sheet storage cassette 38 set to the sheet supply module 34. Thus, there are cassette presence/absence sensors respectively provided in conjunction with the upper, intermediate and lower sheet storage cassettes 38*a*, 38*b* and 38*c* and are adapted to produce signals $S_{CPa}$, $S_{CPb}$ and $S_{CPc}$ each of logic "1" state respectively in the presence of the sheet storage cassettes 38*a*, 38*b* and 38*c* assembled to the sheet supply module 34. Each of these cassette presence/absence sensors is operative to identify the respectively associated cassette 38*a*, 38*b* or 38*c* either depending on the size of the print sheets P stored therein or on the position of the sheet storage cassette 38*a*, 38*b* or 38*c* within the sheet supply module 34.

Figure 6:
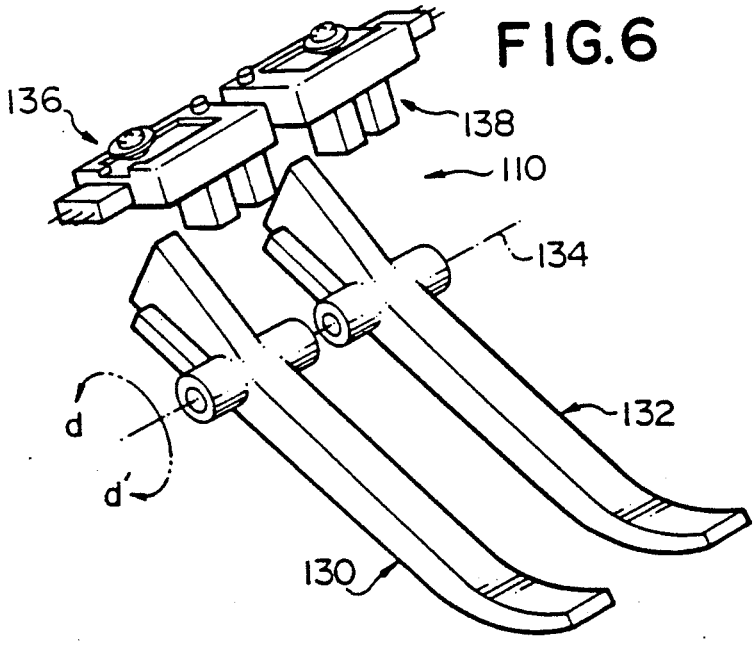
FIG. 6 is a fragmentary, exploded perspective view showing the mechanical features of the cassette sensor arrangement schematically illustrated in FIG. 5.
Figure 7A:
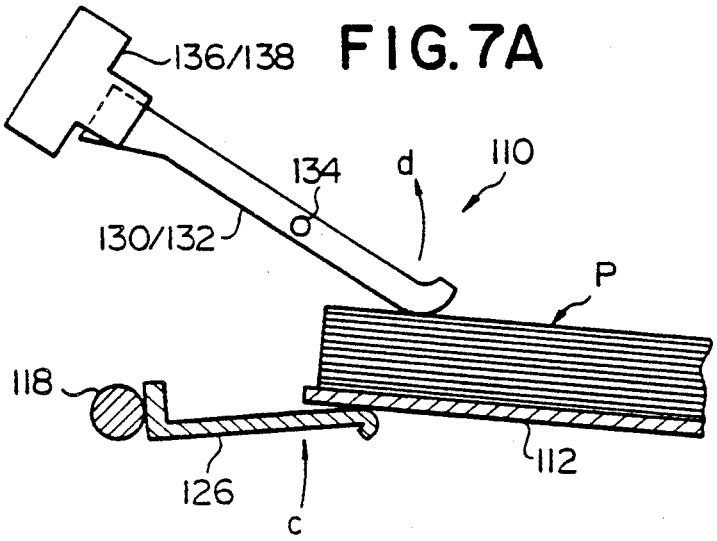
FIGS. 7A, 7B, 7C and 7D are fragmentary side elevation views schematically showing each of various operational conditions of the cassette sensor arrangement illustrated in FIG. 6.

In FIG. 6 is shown one of the cassette sensor arrangements 110*a*, 110*b* and 110*c* provided in association with the sheet storage cassettes 38*a*, 38*b* and 38*c*, respectively. Referring to FIG. 6, in which the cassette sensor arrangements 110*a*, 110*b* and 110*c* are represented by a sensor arrangement 110, comprises first and second rockable probe elements 130 and 132 pivotally mounted on a common supporting rod 134 extending in parallel with the shaft 118 and secured at both ends to the housing of the sheet supply module 34. The probe elements 130 and 132 are rockable independently of each other on the supporting rod 134 each in directions of arrows d and d' about the center axis of the rod 134. Each of the probe elements 130 and 132 has one arm portion extending over the paper support plate 112 of the sheet storage cassette 38 and is biased to turn about the center axis of the rod 134 in the direction of the arrow d' due to the weight of its own. In the presence of a stock of print sheets P received on the paper support plate 112, therefore, the arm portion of each of the probe elements 130 and 132 rests on the uppermost one of the print sheets P on the paper support plate 112 as will be seen from FIG. 7A. The arm portion of the second probe element 132 in particular extends over the slot 114 in the paper support plate 114 of the sheet storage cassette 38 as will be seen from FIG. 5.

Each of the first and second probe elements 130 and 132 has another or rear arm portion extending in the opposite direction from the supporting rod 134. In conjunction with such first and second probe elements 130 and 132 are provided photoelectric transducers 136 and 138, respectively, each having a pair of spaced parallel lug portions. One of the lug portions of each of the photoelectric transducers 136 and 138 has provided thereon a light emitter element which may be implemented by a light emitting diode and the other of the lug portions has provided thereon a photosensitive element such as a photodiode.

The rear arm portion of of each of the probe elements 130 and 132 is arcuately movable through the spacing between such spaced parallel lug portions of each of the photoelectric transducers 136 and 138. When the rear arm portion of the probe element 130 or 132 is located between the lug portions of the associated one of the transducers 136 and 138, the beam of light emanating from the light emitter element on one of the lug portions toward the other is intercepted by the arm portion of the probe element. Under such a condition, the transducer 136 or 138 produces a signal of logic "0" state in the absence of a beam of light received by the photosensitive element on the latter lug portion. When the rear arm portion of the probe element 130 or 132 is then moved out of the spacing between the lug portions of the associated transducer, the beam of light from the light emitter element is allowed to reach the photosensitive element so that the transducer 136 or 138 produces a signal of logic "1" state.

Thus, when the motor 124 is in operation, the motor 124 may drive the shaft 118 through the gear assembly 122 and sector gear 120 for rotation about its center axis either in the direction of the arrow b. The lever plate 126 attached to the shaft 118 is brought into upwardly pressing engagement with the bottom face of the paper support plate 112 of the sheet storage cassette 38 so that the stock of print sheets P, if stored in the cassette 38, is caused to move upwardly within the cassette 38 as the lever plate 126 is caused to turn in the direction of the arrow c as will be seen from FIG. 7A.

Figure 7B:
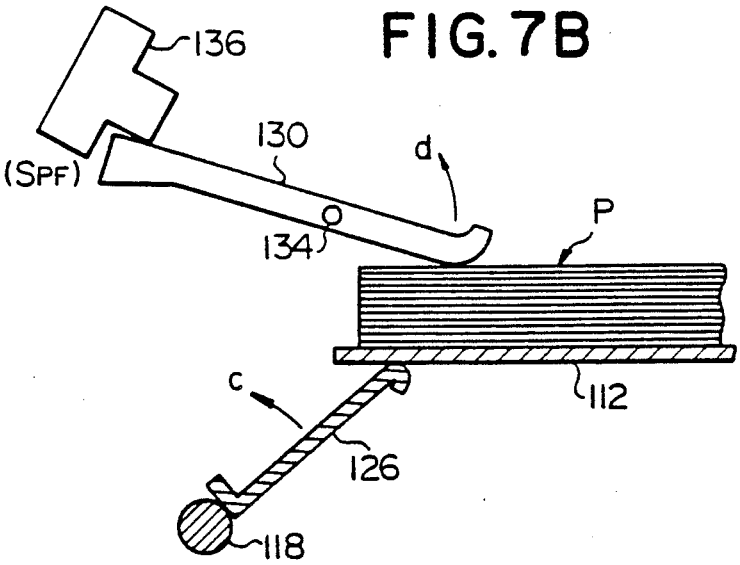

As the stock of the print sheets P is thus caused to move upwardly within the sheet storage cassette 38, the first probe element 130 having one of its arm portions resting on the stock of the print sheets P is caused to turn in the direction of the arrow d about the center axis of the supporting rod 134. The rear arm portion of the first probe element 130 is however allowed to stay in the spacing between the lug portions of the associated photoelectric transducer 136 until the lever plate 126 is turned through a certain angle which is variable with the thickness of the stock of the print sheets P in the sheet storage cassette 38. After the lever plate 126 is turned through such an angle about the center axis of the supporting rod 134, the rear arm portion of the first probe element 130 is moved downwardly out of the spacing between the lug portions of the associated photoelectric transducer 136 as shown in FIG. 7B. The photoelectric transducer 136 associated with the first probe element 130 is thus activated to produce a signal $S_{PE}$ of logic "1" state in the presence of a beam of light received by the photosensitive element forming part of the transducer 136.

Figure 7C:
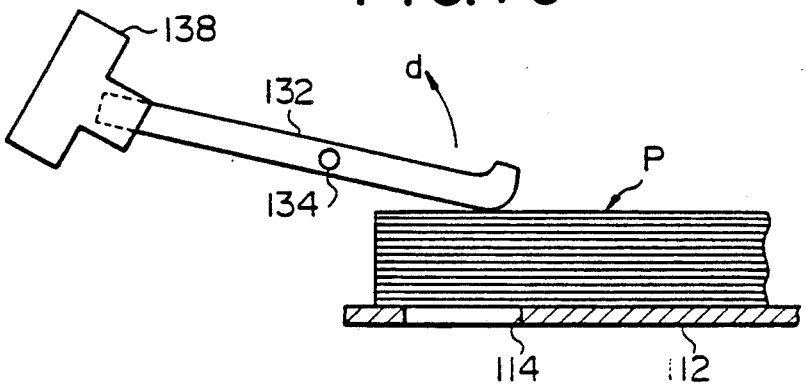
Figure 7D:
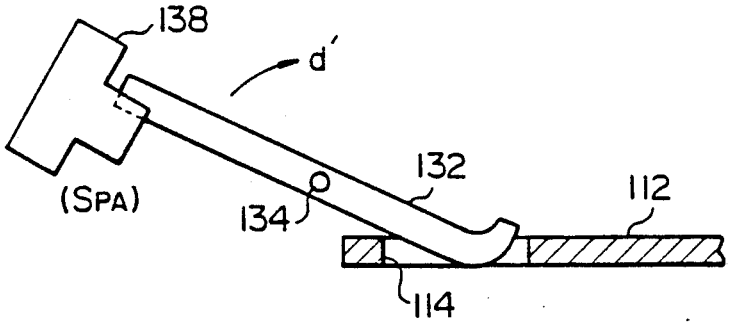

The second probe element 132 having one of its arm portions resting on the stock of the print sheets P is also caused to turn in the direction of the arrow d about the center axis of the supporting rod 134 as the stock of the print sheets P is caused to move upwardly within the sheet storage cassette 38. The rear arm portion of the first probe element 130 is however allowed to stay in the spacing between the lug portions of the associated photoelectric transducer 138 insofar as there is at least a single print sheet P remaining within the sheet storage cassette 38, as will be seen from FIG. 7C. If, however, there is no print sheet received on the paper support plate 112 of the sheet storage cassette 38, the front arm portion of the second probe element 132 is allowed to drop into the slot 114 in the paper support plate 112 of the sheet storage cassette 38 as will be seen from FIG. 7D. With the second probe element 132 being thus turned to the angular position having its front arm portion received in the slot 114, the rear arm portion of the probe element 132 is moved upwardly out of the spacing between the lug portions of the associated photoelectric transducer 138. The photoelectric transducer 138 associated with the second probe element 130 is thus activated to produces a signal $S_{PP}$ of logic "1" state in the presence of a beam of light received by the photosensitive element forming part of the transducer 138 or in the absence of a print sheet stored within the sheet storage cassette associated with the transducer 138.

Thus, the cassette sensor arrangements 110*a*, 110*b* and 110*c* provided in conjunction with the upper, intermediate and lower sheet storage cassettes 38*a*, 38*b* and 38*c*, respectively, further produce signals $S_{PEa}$, $S_{PEb}$ and $S_{PEc}$ each of logic "1" state when the paper support plates 112 of the sheet storage cassettes 38*a*, 38*b* and 38*c* are moved upwardly within the cassette. From the cassette sensor arrangement 110*a*, 110*b* or 110*c* is further produced a signal $S_{PAa}$, $S_{PAb}$ or $S_{PAc}$ of logic "1" state in the absence of at a print sheet P within the sheet storage cassette 38*a*, 38*b* or 38*c*, respectively.

FIG. 8 shows the general arrangement of a printer control system which forms part of the printer apparatus embodying the present invention. The printer control system, generally represented by reference numeral 200, is coupled with a standard-type host data processor unit 202 preferably through a file buffer circuit 204 by way of buses B1 and B2. From the host data processor unit 202 herein used is to be supplied data including those representative of the image to be printed and those representative of the control procedures in accordance with which the image is to be printed. Such image and control data is output from the host data processor unit 202 in accordance with prescribed rules and formats which form a particular communications protocol.

The data supplied from the host data processor unit 202 through the bus B1 is once stored in the file buffer circuit 204 and is thereafter supplied through the bus B2 to the printer control system 200, particularly to a bit-map data processing network 206 which forms part of the printer control system 200. The printer control system 200 comprises, in addition to the data processing network 206, a print engine control network 208 which communicates with the bit-map data processing network 206 by way of a control data bus B3 or through an image data bus B4 as shown. The print engine control network 208 in turn is connected to a paper supply control circuit 210 to control the record medium supply unit implementing the sheet supply module 34, and a sorter control circuit 212 to control a printed output sorter which is implemented by the print output module 36 of the printer apparatus 30 embodying the present invention. The detailed arrangements of preferred examples of the bit-map data processing network 206 and print engine control network 208 are depicted in FIG. 9.

Referring to FIG. 9, the bit-map data processing network 206 comprises memory means including a bit-map random-access memory (RAM) unit 214 for storing image information, and a font memory unit 216 which has a collection of alphanumerical font data fixedly stored therein. The bit-map data processing network 206 further comprises a bit-map data read/write control circuit 218 connected through a bus B5 to the RAM unit 214 and through a bus B6 to the font memory unit 216 and a bit-map control circuit 220 responsive to data from the file buffer circuit 204 through the bus B2 and connected through a bus B7 to the bit-map data read/write control circuit 218. The bit-map data read/write control circuit 218 is operative to read font data from the font memory unit 216 through the bus B6 and load bit-map image data into the RAM unit 214 through the bus B5. The bit-map control circuit 220 is responsive to data from the file buffer circuit 204 through the bus B2. Upon receipt of data from the file buffer circuit 204 through the bus B2, the bit-map control circuit 220 outputs intermediate code signals, on the basis of which the bit-map memory unit 214 is accessed at any addresses thereof and/or the font memory unit 216 is accessed at any addresses thereof through the bit-map read-write control circuit 218 and by way of the buses B5 and B6, respectively, as will be described in more detail. The bit-map control circuit 220 is also connected through a bus B8 to the font memory unit 216 as shown.

On the other hand, the print engine control network 208 comprises three control circuits which consist of an interface control circuit 222, an electrophotographic process control circuit 224, and a print head control circuit 226. The interface control circuit 222 processes the data received from the bit-map control circuit 220 through the control data bus B3 and controls the selective activation of the indicators 46*a* and 48 to 58 and display window 60 on the control panel 40 shown in FIG. 2. The interface control circuit 222 is further operative to control the timings at which the various functional units and members incorporated in the print engine module 32 shown in FIG. 1 are to be activated and de-activated. Such timings are controlled by signals transmitted through an internal bus B9 in the print engine control network 208. The electrophotographic process control circuit 224 is responsive to the data supplied from the interface control circuit 222 through the internal bus B9 and dictates the operation of an electrophotographic process stage 228 incorporated in the print engine module 32 of the printer apparatus 30. An electrophotographic process stage of a printer apparatus is per se well known in the art and for this reason will not be herein described to avoid prolixity of description.

The print head control circuit 226 is responsive to the data supplied from the bit-map data read/write control circuit 218 through the image data bus B4 and dictates the operation of a print head 230 also incorporated in the print engine module 32. The print head 230 incorporated in the print engine module 32 of the printer apparatus 30 is assumed to be of the laser type by way of example and, thus, the print head control circuit 226 herein provided is operative to control the activation of, for example, a semiconductor laser generator and an associated control motor, though not shown in the drawings. The interface control circuit 222 is further connected through the internal bus B9 of the network 208 to the paper supply and sorter control circuits 210 and 212 to control the sheet supply module 34 and the printed output sorter included in the print output module 36 of the print engine module 32.

Figure 10:
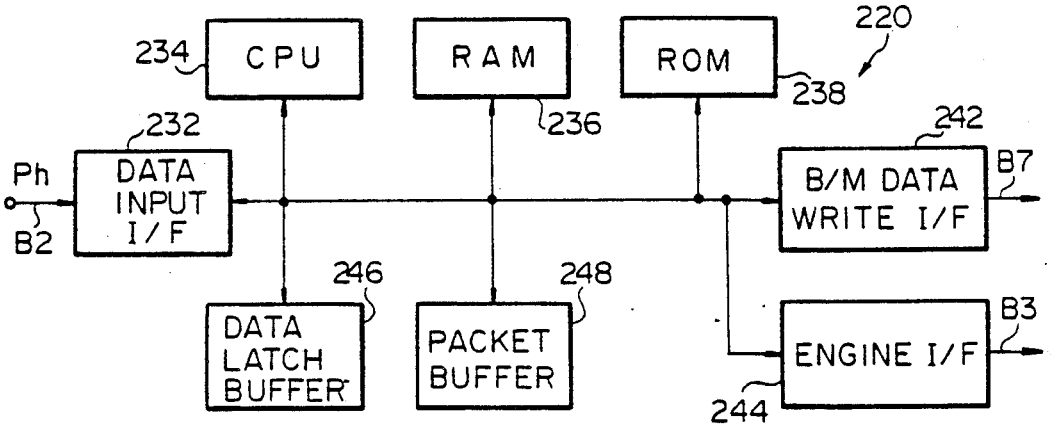
FIG. 10 is a block diagram showing the detailed circuit arrangement of a preferred example of the bit-map control circuit which forms part of the bit-map data processing network illustrated in FIG. 9.

FIG. 10 shows the detailed circuit arrangement of a preferred example of the bit-map control circuit 220 which thus forms part of the bit-map data processing network 206. As shown, the bit-map control circuit 220 comprises a data input interface section 232 connected through the file buffer circuit 204 to the host data processor unit 202 (FIG. 8). The bit-map control circuit 220 further comprises a central processing unit 234, a system RAM unit 236 and a system read-only memory (ROM) unit 238 which are coupled together by a common bus 240 which extends from the data input interface section 232 to output interface sections. The system RAM unit 236 provides a working memory area for the central processing unit 234 and is used for the temporary storage of the contents of the registers in the central processing unit 234 and various basic flags to be used in the central processing unit 234. In the system read-only memory unit 238 are stored sets of instructions to be executed by the central processing unit 234.

The output interface sections leading from the common bus 240 include a data write interface section 242 connected to the bit-map data read/write control circuit 218 through the bus B7, and a print engine interface section 244 connected to the interface control circuit 222 of the print engine control network 208 through the control data bus B3. The print engine interface section 244 supplies and receives various pieces of job information including those representative of the number of the printed outputs to be produced and various pieces of job control information to and from the print engine control network 208 through the control data bus B3. The central processing unit 234 may be interrupted periodically by a timer circuit (not shown) which supplies a series of interrupt signals to the central processing unit 234.

The bit-map control circuit 220 shown in FIG. 10 further comprises a data latch buffer register 246 for storing the image and control data introduced into the bit-map control circuit 220 through the data input interface section 232 of the control circuit 220. The image and control data thus loaded into the data latch buffer register 246 is then transferred to a packet buffer register 248. Before the data is transferred to the packet buffer register 248, the data received by the data latch buffer register 246 is re-formulated into packets in the form of function-type intermediate code signals. The data packets thus produced by the data latch buffer register 246 include image data packets each consisting of address data representative of the address of any font or alphanumerical image and control data packets each consisting of data in accordance with which the font or alphanumerical image is to be reproduced. The data re-formulated into such packets is adapted to be readily accepted by the bit-map read/write control circuit 218 of the bit-map data processing network 206. While the image corresponding to the data read from the bit-map RAM unit 214 is being printed, the addresses of the font memory unit 216 from which font data is to be read by the bit-map data read/write control circuit 218 and the addresses of the bit-map RAM unit 214 into which image data is to be loaded by the read/write control circuit 218 are calculated from the packet data stored in the packet buffer register 248. The packet data is loaded into and read from the packet buffer register 248 on a first-in first-out (FIFO) basis.

Figure 11:
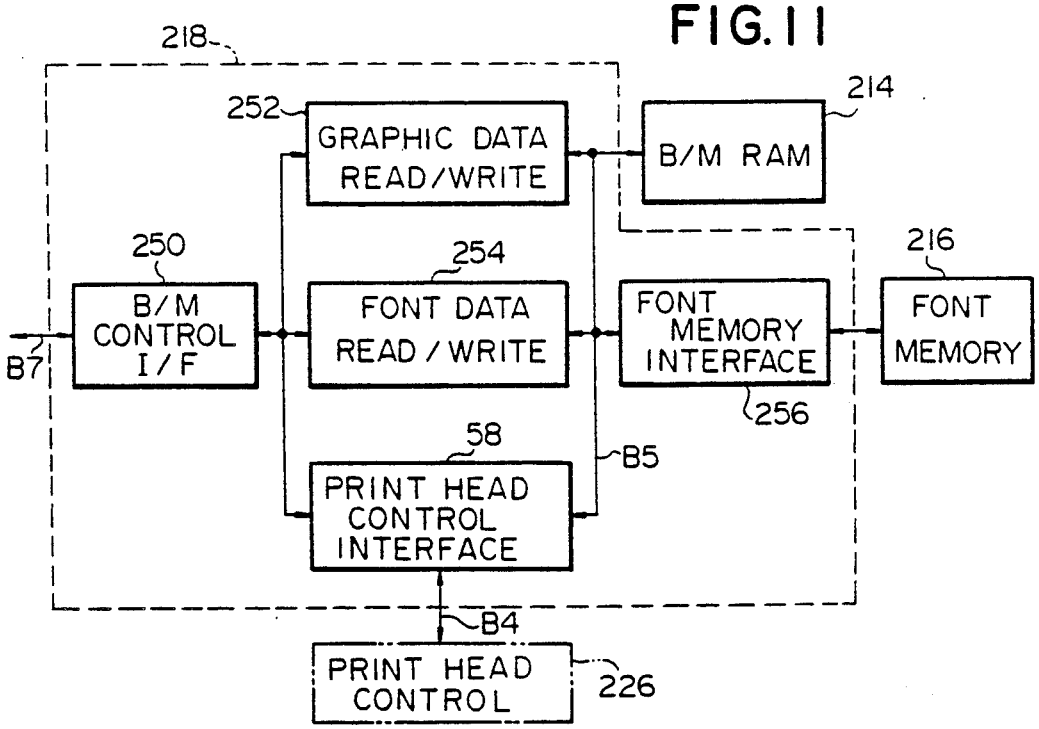
FIG. 11 is a block diagram showing an example of the detailed arrangement of a bit-map data read/write circuit which forms part of the bit-map data processing network illustrated in FIG. 9.

FIG. 11 shows an example of the detailed configuration of the bit-map data read/write control circuit 218 which forms part of the bit-map data processing network 208 described with reference to FIG. 9. The major functions of the bit-map data read/write control circuit 218 of the bit-map data processing network 208 include a function to write image data into the bit-map RAM unit 214 when such data is loaded into the apparatus 30. The bit-map data read/write control circuit 218 has another function to read data from the RAM unit 214 for transmission to the print engine control network 208 through the bit-map control circuit 220 during printing operation. Thus, the bit-map data read/write control circuit 218 comprises a bit-map control interface circuit 250 connected through the bus B7 to the bit-map control circuit 220 of the bit-map data processing network 208.

Data may be written into or read out of the bit-map RAM unit 214 through a graphic image data read/write control circuit 252 and/or a font data read/write control circuit 254. Each of these graphic and font image data read/write control circuits 252 and 254 is composed of a logic network connected through the bit-map control interface circuit 250 to the bit-map control circuit 220 and operates on intermediate code signals supplied from the bit-map control circuit 220. The graphic image data read/write control circuit 252 is connected between the bit-map control interface circuit 250 and the bit-map RAM unit 214 and controls the reading or writing of data representative of graphic features out of or into the RAM unit 214. In controlling the writing of data into the bit-map RAM unit 214, the read/write control circuit 252 processes the intermediate code signals received from the bit-map control circuit 220 mostly through analysis into such signals. On the other hand, the font data read/write control circuit 254 is connected between the bit-map control interface circuit 250 and font memory unit 216 through a font memory interface circuit 256 and controls the reading of alphanumerical data out of the font memory unit 216. In response to the intermediate code signals received from the bit-map control circuit 220, the read/write control circuit 254 reads data from the font RAM unit 216 and writes the data into the bit-map memory unit 214 without analyzing the intermediate code signals received from the bit-map control circuit 220.

The data read/write control circuit 218 further comprises a print head control interface circuit 258 operative to read data from the bit-map RAM unit 214 under the control of the print head control circuit 226 forming part of the print engine control network 208. The print head control interface circuit 258 is responsive to a print start code signal supplied from the bit-map control circuit 220 through the bit-map control interface circuit 250 and to a synchronizing signal supplied from the print head control circuit 226 through the image data bus B4. In response to such signals from the bit-map and print head control circuits 220 and 226, the print head control interface circuit 258 transmits to the print head control circuit 226 of the print engine control network 208 the data which has been read out from the bit-map RAM unit 14.

The mode of operation of the printer apparatus 30 incorporating the printer apparatus embodying the present invention thus constructed and arranged will now be described.

Main Routine Program

Figure 12:
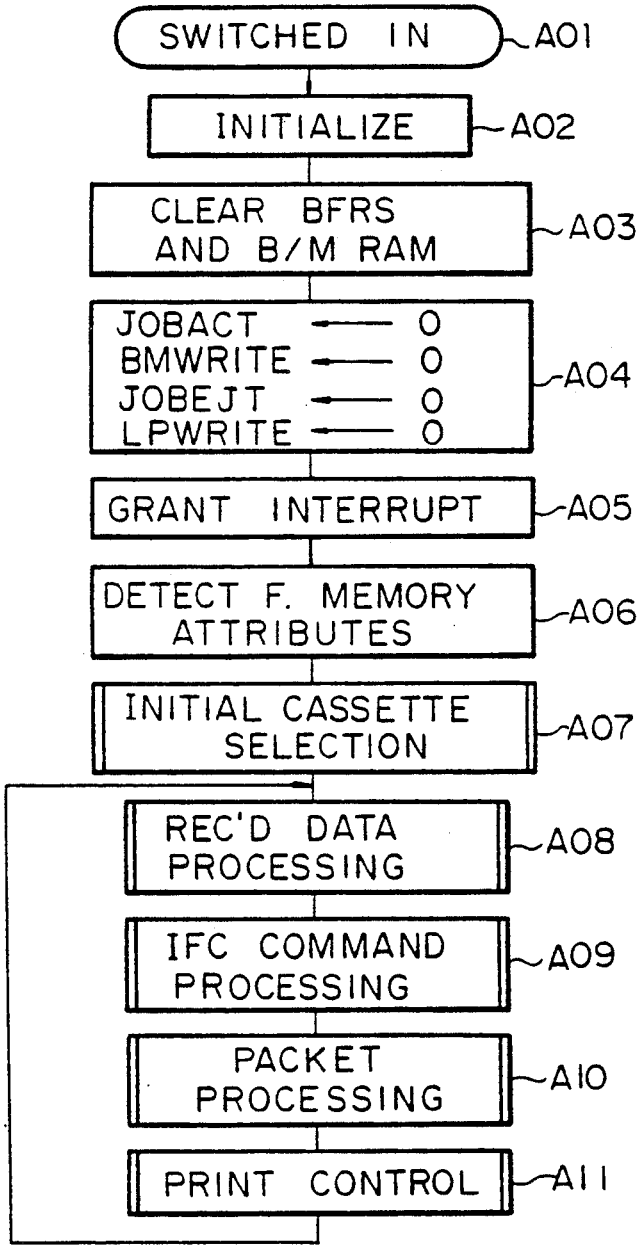
FIG. 12 is a flowchart showing the main routine program in accordance with which a bit-map control circuit which also forms part of the data processing network is to operate under the control of the central processing unit included in the data processing network of the printer control system which forms part of the printer apparatus embodying the present invention.

FIG. 12 shows the main routine program in accordance with which the bit-map control circuit 220 of the data processing network 16 is to operate in response to data from the file buffer circuit 204 through the bus B2 and data from the bit-map data read/write control circuit 218 as hereinbefore described with reference to FIG. 9. The routine program is executed to initialize the system central processing unit 234 and the peripheral devices thereof when the printer apparatus 30 under consideration is switched in. With the printer apparatus 30 thus switched in, the main routine program is started as at step A01 so that the host data processor unit 202 and all the memories, buffers and registers associated with the data processor unit 202 are initialized at step A02. The bit-map RAM unit 214 and the data latch buffer register 246 and packet buffer register 248 (FIG. 10) are also initialized at step A03 so that the content of each of these memory unit and buffer registers is cleared.

The main routine program then proceeds to step A04 at which job control flags representative of various operational parameters used by the central processing unit 234 are initialized each to logic "0" state. Such job control flags include flags "JOBACT", "BMWRITE", "JOBEJT" and "LPWRITE".

Of these, the job control flag JOBACT when having a logic "1" state indicates that a job is still in progress for the printing of a print sheet or typically that a printing operation for producing a specified number of printed outputs for a given page of original image information is still incomplete. In the presence of the job control flag JOBACT of logic "1" state, it is thus determined that a request for producing a specified number of printed outputs for a given page of original image information has not been fulfilled and that the printer apparatus 30 is required to proceed with the printing operation for the currently given page of image information.

The job control flag BMWRITE which when having a logic "1" state indicates that the bit-map RAM unit 214 currently has any data which has been written thereinto.

The job control flag JOBEJT when having a logic "1" state indicates that there currently is a request for starting printing operation.

The job control flag LPWRITE when having a logic "1" state indicates that the data passed to the data latch buffer register 246 is being re-formulated into packets or function-type intermediate code signals for storage into the packet buffer register 248.

After these job control flags JOBACT, BMWRITE, JOBEJT and LPWRITE have been initialized each to logic "0" state, a request for a timed interrupt to the central processing unit 234 is granted at step A05. The step A05 may be followed by a step A06 at which the attributes of the data stored in the font memory unit 216 are detected from the memory unit 216 to establish a format for the printing of font images. An initial paper storage cassette select control subroutine A07 may then be executed to initially select one of the sheet storage cassettes 38*a*, 38*b* and 38*c* in the sheet 34, whereupon the central processing unit 234 proceeds to a loop of subroutines predominant over various steps to be followed for printing operation. These subroutines include a data processing subroutine A08, an IFC command processing subroutine A09, a packet processing subroutine A10 and a print control subroutine A11.

The data processing subroutine A08 is predominant over the operation for the processing of the data received from the host data processor unit 202. As noted previously, the data supplied from the host data processor unit 202 include those representative of the images to be printed and those representative of the control procedures in accordance with which the images are to be printed. The details of this data processing subroutine A08 will be hereinafter described with reference to FIG. 14.

The interface control (IFC) command processing subroutine A09 is used to process the control data supplied from the interface control circuit 222 of the print engine control network 208 (FIG. 9). The details of this interface control command processing subroutine A09 will be hereinafter described with reference to FIG. 15.

By the packet processing subroutine A10, the packet data supplied from the packet buffer register 248 is loaded through the bit-map data read-write control circuit 218 into the bit-map RAM unit 214. The details of this packet processing subroutine A10 will be hereinafter described with reference to FIG. 16.

The print control subroutine A11 is used to execute a sequence of control steps in accordance with the control data supplied from the interface control circuit 222 of the print engine control network 208. The details of this print control subroutine A11 will be described with reference to FIG. 17.

Data Processing Subroutine

Figure 14:
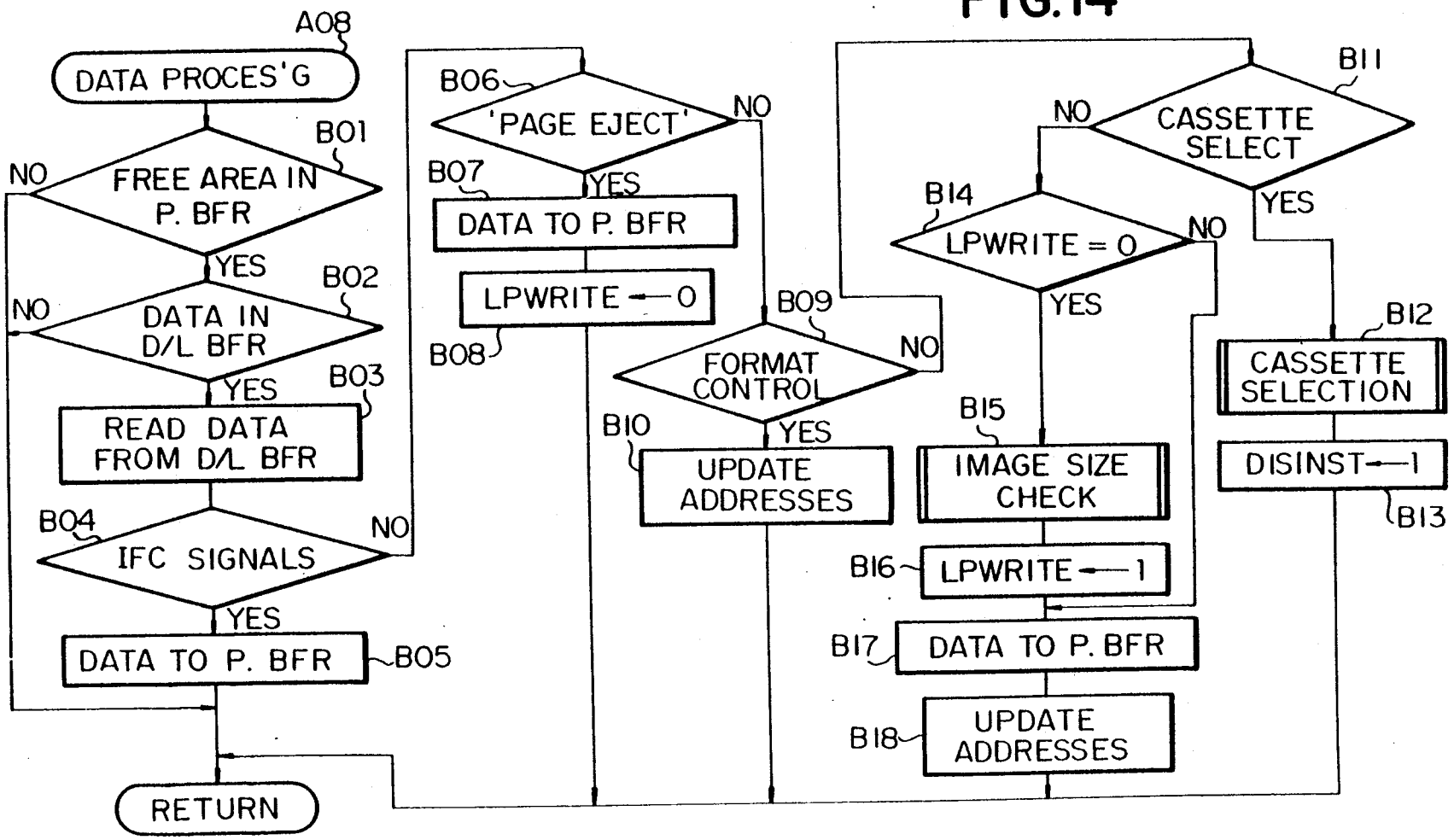
FIG. 14 is a flowchart showing the details of a data processing subroutine included in the main routine program illustrated in FIG. 12.

FIG. 14 shows the details of the data processing subroutine A08 included in the main routine program illustrated in FIG. 12. The data processing subroutine A08 starts with a step B01 at which it is confirmed whether or not the packet buffer register 248 has a free memory area available for the storage of data therein. If it is found that there currently is a free memory area, it is tested at step B02 whether or not there is data stored in the data latch buffer register 246 and, if it is found that there is data stored in the buffer register 246, the data is read from the buffer register 246 at step B03. The data thus read from the data latch buffer register 246 is to be re-formulated into packets which are readily acceptable by the bit-map read/write control circuit 218 of the bit-map data processing network 206 as previously noted. Subsequently to the step B03, it is tested at step B04 whether or not the data read from the data latch buffer register 246 consists of coded signals which are to be used in the interface control circuit 222. Such coded signals include a signal dictating the number of the printed outputs to be produced for a page of original image information and a signal indicating the sheet storage cassette to be selected for use. If the answer for this step B04 is given in the affirmative, the step B05 is followed by a step B05 at which the data is re-formulated into packets and the resultant packet data is supplied to the packet buffer register 248. The format of the packet into which the control data associated with the interface control circuit 222 is to be re-formulated is different from that used for the re-formulation of image data in the packet data processing subroutine A10 so that the re-formulation of the control data can be performed in synchronism with the re-formulation of the image data.

If it is determined at step B04 that the data read from the data latch buffer register 246 contains no code signals to be processed in the interface control circuit 222, then it is tested at step B06 whether or not the data in question consists of a coded signal PAGE EJECT of logic "1" state which is indicative of the termination of the storage of image data into the bit-map RAM unit 214 and which is thus used for the pagination of printed outputs. If it is found at the step B06 that the coded signal PAGE EJECT of logic "1" state is present, it is determined that the storage of the image data into the RAM unit 214 is complete so that the step B06 is followed by a step B07 at which the data is also re-formulated into packets and the resultant packet data is supplied to the packet buffer register 248. Thus, the re-formulation of the signal PAGE EJECT is also performed in synchronism with the re-formulation of image data. While the packet data for the PAGE EJECT signal is thus supplied to the packet buffer register 248, the job control flag LPWRITE which has been of the logic "1" state is reset to logic "0" state at step B08 to indicate that the data passed to the data latch buffer register 246 has been re-formulated into packets and stored into the packet buffer register 248.

If the answer for the step B06 is given in the negative, it is then queried at step B09 whether or not the data read from the data latch buffer register 246 consists of coded format control signals to dictate the format in accordance with which the images are to be printed. If it is found that this is the case, the addresses of the data to be stored into the bit-map RAM unit 214 are updated at step B10. If it is determined at step B09 that the data read from the data latch buffer register 246 contains no coded signals dictating the printing format, it is tested at step B11 whether or not the data contains a cassette select signal to select any of the sheet storage cassettes 38*a*, 38*b* and 38*c* available in the paper supply unit 34. If it is found that such a signal is contained in the data read from the buffer register 246, a cassette select subroutine B12 is executed to select the particular sheet storage cassette 38*a*, 38*b* or 38*c* specified by the cassette select signal. Upon completion of the subroutine B12, a flag DISINST is set to logic "1" state as at step B13 to inhibit selection of a cassette on the part of the printer control system 200. Thus, when a sheet storage cassette is selected on the basis of an instruction transferred from the host data processor unit 202 to the printer control system 100, control system 100 is disabled from selecting any sheet storage cassette thereafter.

If it is found at step B11 that there is no cassette select signal contained in the data read from the buffer register 246, it is determined that the data received from the data latch buffer register 246 consists of the font image data to be reproduced. In this instance, it is tested whether or not the job control flag LPWRITE has been of the logic "1" state is reset to logic "0" state at step B13 and, if it is found that it is, an image print size check subroutine B15 is executed to see if a new sheet storage cassette has been selected and if, there is a new sheet storage cassette found to be selected, the size to which the images are to be reproduced is acceptable for the size of the print sheets P to be supplied from the newly selected sheet storage cassette. The details of the image print size check subroutine B15 will be hereinafter described with reference to FIG. 19.

Upon completion of the image print size check subroutine B15, the job control flag LPWRITE is set to logic "1" state at step B16 to indicate that the re-formulation of the data passed to the data latch buffer register 246 into packets has been started. Subsequently to the step B16, the addresses of the font images represented by the packet data output from the data latch buffer register 246 are stored into the packet buffer register 248 as at step B17 and, at the same time, the bit-map data read-write control circuit 218 establishes a data write mode to store data into the bit-map RAM unit 214. In this instance, the re-formation of the image data into packets is effected in accordance with the format established from the attributes of the data stored in the font memory unit 216 as detected from the memory unit 216 by the step A06 of the main routine program described with reference to FIG. 12. The step B17 is followed by a step B18 at which the addresses of the bit-map RAM unit 214 are updated to addresses at which the font images represented by the data received are to be stored for the reproduction of the images with the currently detected image print size.

The addresses at which certain pieces of font image data are to be stored for reproduction with a modified image print size.

Figure 13:
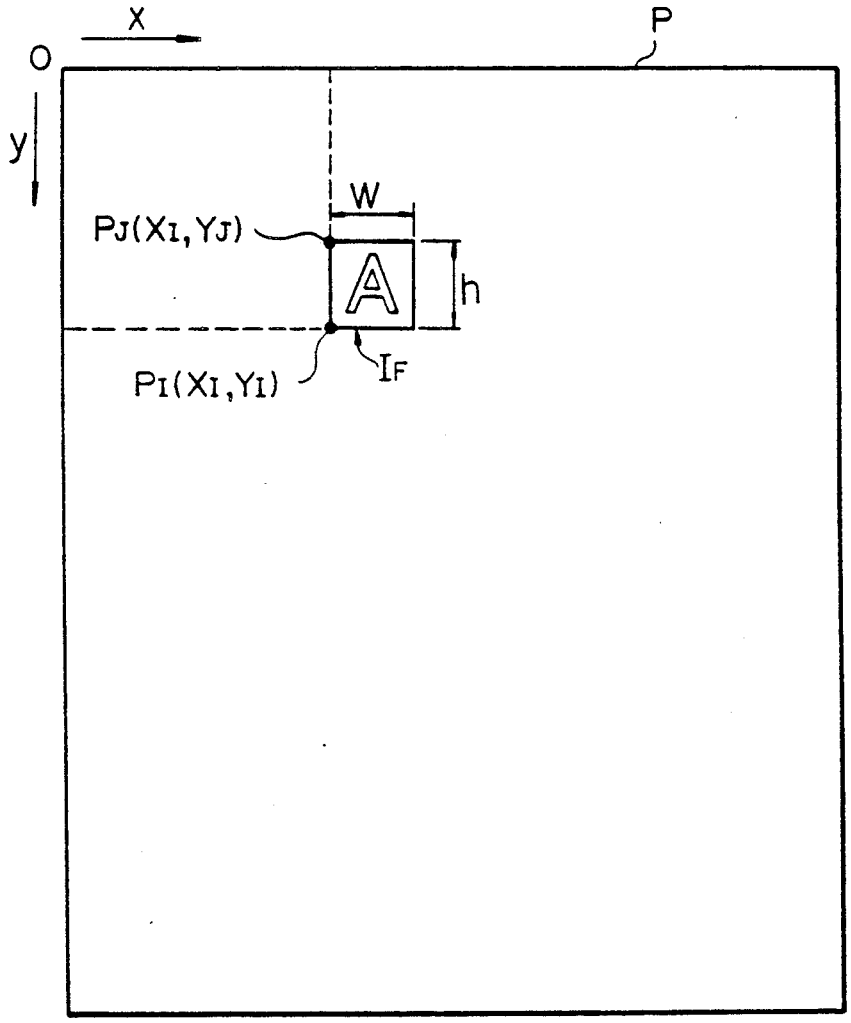
FIG. 13 is a plan view showing a location at which an alphanumeric image represented by a font image data from the font memory unit included in the bit-map data processor network shown in FIG. 9 may be printed on a sheet of paper.

FIG. 13 is a plan view showing a location at which an alphanumerical image $I_F$ represented by a font image data read from the font memory unit 216 is printed on a sheet of paper P used as a record medium in the printer apparatus to which the present invention appertains. The printed image $I_F$ is assumed to have a 16-bit width w and a 16-bit height h and to have a certain address in the bit-map RAM unit 214. The location of the printed image $I_F$ on the sheet of paper P is represented by the coordinate $P_I(X_I, Y_I)$ which the image has at its lower left corner point in an xy-coordinate system having the origin O at the upper left corner of the sheet P. By reason of the hardware arrangement to produce such a printed image, the address which the printed image $I_F$ has in the bit-map RAM unit 214 is given not by the coordinate $P_I(X_I, Y_I)$ but by the coordinate $P_J(X_I, Y_J)$ which the image has at its upper left corner point. Thus, the address $A_F$ at which the font image to result in the printed image $I_F$ is to be written into the bit-map RAM unit 214 is given as:

$$A_F=(Y_I-h)*h*16+X_I*w*16$$

The format in accordance with which the font images are to be stored into the bit-map RAM unit 214 is determined on the basis of this relationship and may be said to be an imaginary format in that the format is different from the format in accordance with which the font images are to be actually printed on a print sheet P. When the starting image on the starting line is to be printed, the size of the print sheet P to be supplied from the currently selected sheet storage cassette 38*a*, 38*b* or 38*c* is checked to be acceptable for the size of the image to be printed as at the step B14 and, in addition, the job control flag LPWRITE is set to logic "1" state at step B15 to indicate that the re-formulation of the data passed to the data latch buffer register 246 into packets has been started as above noted.

Interface Control Command Processing Subroutine

Figure 15:
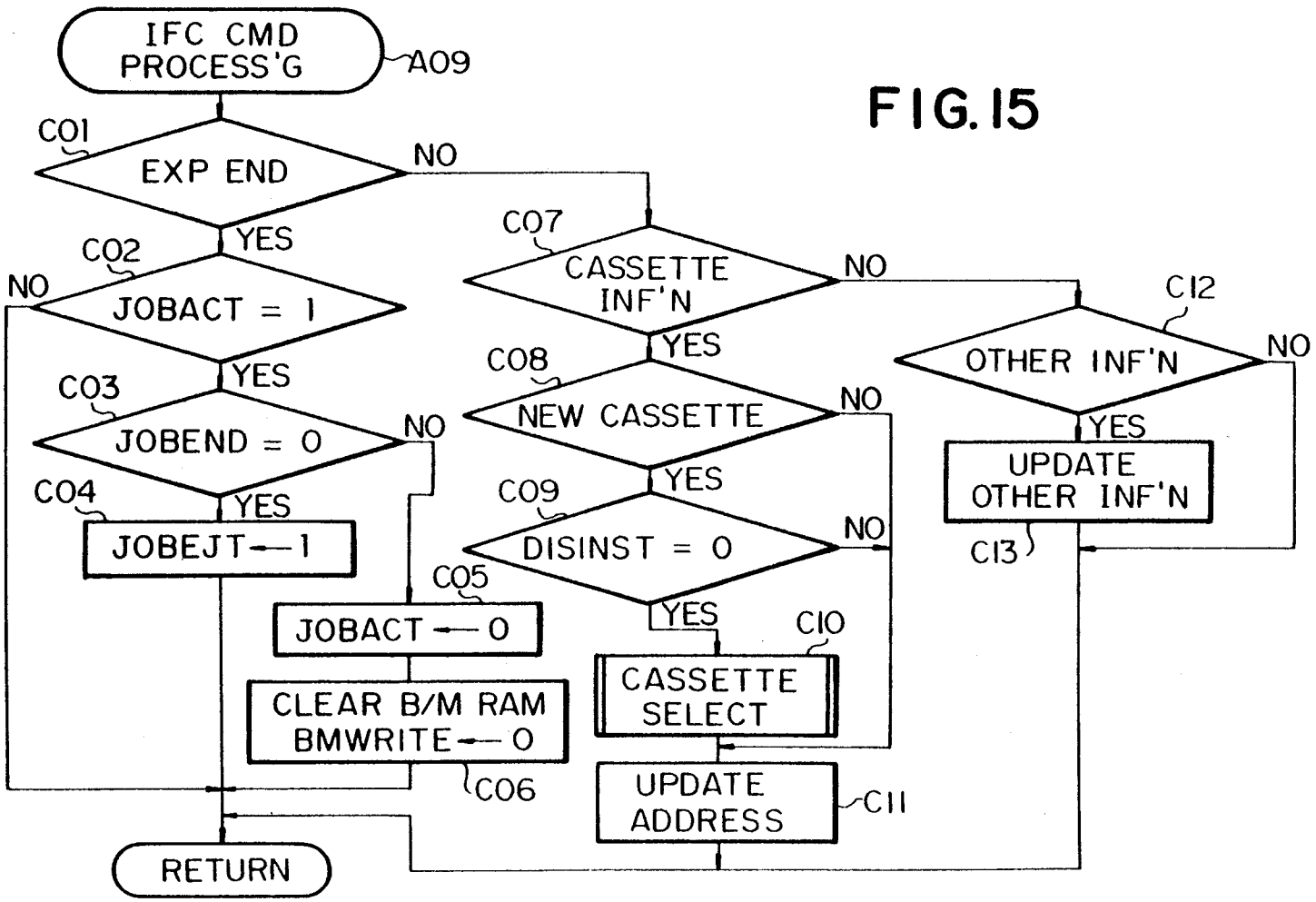
FIG. 15 is a flowchart showing the details of an interface control (IFC) command processing subroutine included in the main routine program illustrated in FIG. 12.

FIG. 15 shows the details of the interface control (IFC) command processing subroutine A09 included in the main routine program described with reference to FIG. 12. The interface control circuit 222 processing subroutine A09 is predominant over the operation of the interface control circuit 222 and starts with a decision step C01 to confirm whether or not a command signal EXP END is of a logic "1" state indicating that the optical scanning of the currently given page of original image information is complete. The command signal EXP END is used to enable the print engine module 32 to operate in synchronism with the interface control circuit 222 and is thus effective only when a printing operation is in progress. If it is thus found that the scanning of the currently given page of image information is complete and accordingly that the command signal EXP END is of logic "1" state, it is then queried at step C02 whether or not the job control flag JOBACT has a logic "1" state indicating that printing operation is in progress for producing a specified number of printed outputs for a given page of original image information.

In the presence of the job control flag JOBACT of the logic "1" state, it is thus determined that the request for producing the specified number of printed outputs for the given page of original image information has not been fulfilled and accordingly that the printer apparatus 30 is required to proceed with the printing operation for the currently given page of image information. In this instance, it is further questioned at step C03 whether or not a job control flag JOBEND is of a logic "1" state indicating that the printing operation for the given page of original image information is terminated with a single printed output or the specified number of printed outputs produced. If it is found at this step C03 that the job control flag JOBEND is of logic "1" state, the job control flag JOBEJT is set to the logic "1" state at step C04 to indicate that there currently is a request for another cycle of printing operation. The job control flag JOBEJT of the logic "1" state is effective to make the interface control circuit 222 ready to control the print engine module 32 to start for operation to produce a specified number of printed outputs possibly for a new page of original image information.

If it is found at the step C03 that the job control flag JOBEND is of logic "0" state, the step C03 is followed by a step C05 at which the job control flag JOBACT is reset to logic "0" state to indicate that the printing operation is complete for producing the specified number of printed outputs for the given page of original image information and that there is no printed output to be produced for the last given page of original image information. Subsequently to step C05, an instruction signal is issued from the central processing unit 234 to clear the content of the bit-map RAM unit 214 and the job control flag BMWRITE is reset to logic "0" state indicating that the RAM unit 214 has no data stored therein and is thus ready to accept any data to be stored therein. The job control flag JOBEND is thus used either to control the print engine module 32 to start for operation to produce a specified number of printed outputs for a page of original image information or to continue operation until the specified number of printed outputs is produced for the page of original image information. This is because of the fact that the control over the number of the printed outputs to be produced for a given page of original image information is effected by means of the interface control circuit 222.

If it is found at step C01 that the optical scanning of the currently given page of original image information is still in progress with the command signal EXP END remaining in the logic "0" state, it is queried at step C07 whether or not there is information regarding any of the sheet storage cassettes 38*a*, 38*b* and 38*c*. If it is found that there currently is such information, it is tested at step C08 whether or not there is a cassette newly assembled to the sheet supply module 34. If it is found at this step C08 that there is such a cassette, it is tested at step C09 whether or not a flag DISINST is of a logic "0" state which indicates that initial selection of a cassette is allowed. In the presence of the flag DISINST of the logic "0" state, it is determined that the newly selected cassette is the one which has stored therein print sheets of the size desired by the user. If it is thus found at the step C09 flag DISINST has the logic "0" state, the step C09 is followed by a cassette select subroutine C10 to select such a cassette.

After the subroutine C10 is executed completely, the information regarding the cassette as stored in the bit-map RAM unit 214 is updated at step C11 to indicate the newly selected cassette so that the printer control system 200 is capable of coping with a possible change in the size of the image to be reproduced.

If it is found at step C07 that there is no information regarding the sheet storage cassettes, it is further tested at step C09 whether or not there is any information, the corresponding information which has been stored is updated at step C10 to enable the printer control system to cope with the operation complying with the new information.

Packet Processing Subroutine

Figure 16:
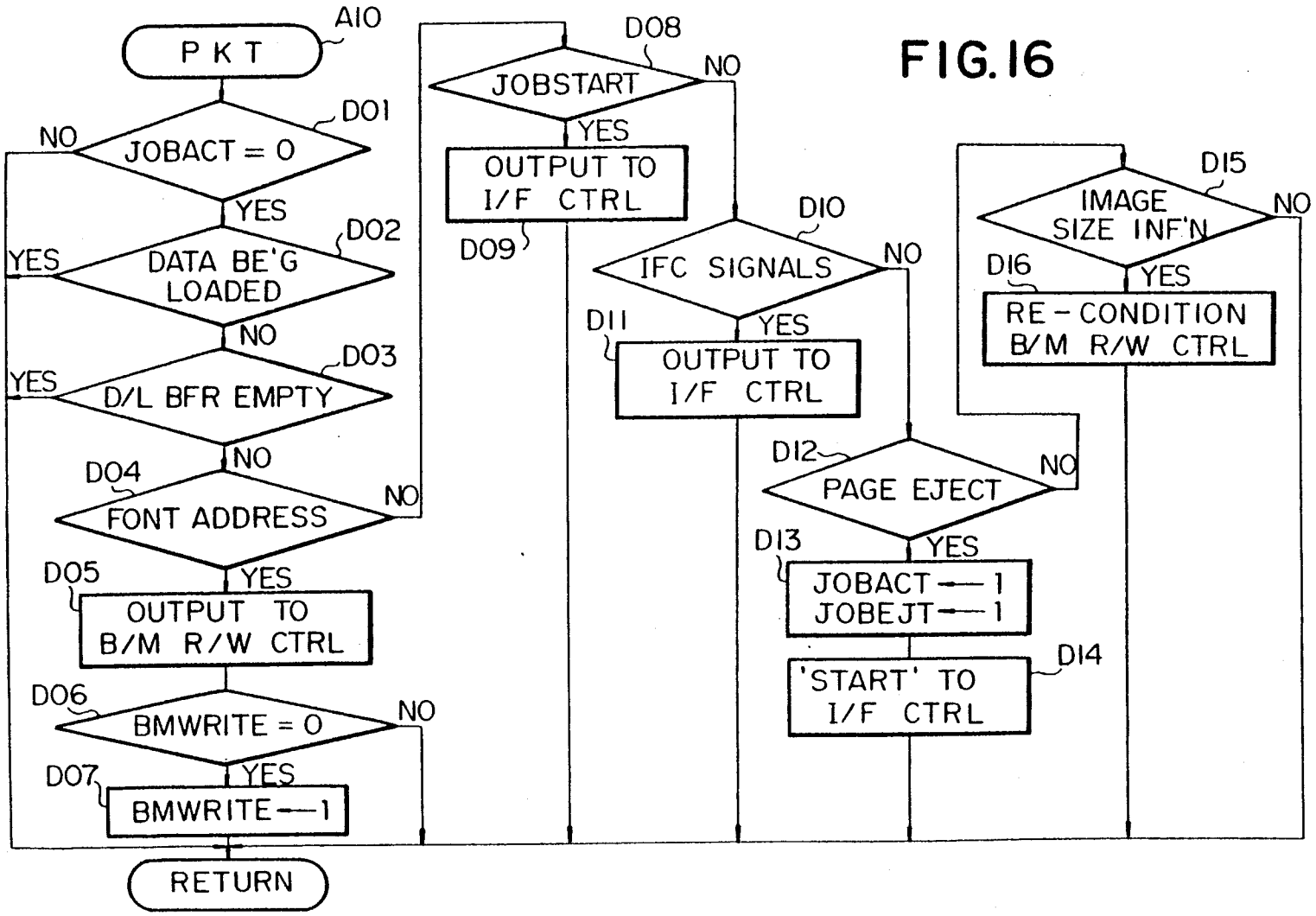
FIG. 16 is a flowchart showing the details of a packet processing subroutine included in the main routine program illustrated in FIG. 12.

FIG. 16 shows the details of the packet processing subroutine A10 included in the main routine program described with reference to FIG. 12. The packet processing subroutine A10 is executed to process the data preliminarily re-formulated into packet form and loaded into the packet buffer register 248. As has been noted, the data packets thus stored in the packet buffer register 248 include image data packets each consisting of address data representative of any font or alphanumerical image and control data packets each consisting of data in accordance with which the font or alphanumerical image is to be reproduced.

The content of the bit-map RAM unit 214 can not be updated before the printing operation for the page of original image information given in the immediately preceding cycle of operation is complete. For this reason, the packet processing subroutine A10 starts with a step D01 to confirm whether or not the job control flag JOBACT has a logic "0" state indicating that printing operation is complete for producing the specified number of printed outputs for the last given page of original image information. If it is found that the job control flag JOBACT is of the logic "1" state, it is determined that the operation for producing the specified number of printed outputs for the given page of original image information is still in progress and, in this instance, the content of the bit-map RAM unit 214 is maintained. In the presence, however, of the job control flag JOBACT of the logic "0" state, it is determined that the operation for producing the specified number of printed outputs for the given page of original image information is complete and that the printer apparatus 30 is required to start printing operation for a new page of original image information. In this instance, the step D01 is followed by a step D02 to check whether or not the bit-map data read-write control circuit 218 is in operation for loading data into the bit-map RAM unit 214. If it is found that this is the case, the content of the bit-map RAM unit 214 is maintained but, if it is found at the step D02 that the bit-map data read-write control circuit 218 is currently not in operation, the step D02 is followed by a step D03 to confirm whether or not the packet buffer register 248 is currently unoccupied. If it is found that there is no data stored in the packet buffer register 248, the content of the bit-map RAM unit 214 is also maintained.

If, however, it is found at the step D03 that there is remains data stored in the packet buffer register 248, the step D03 is followed by a step D04 to confirm whether or not the data stored in the packet buffer register 248 consists of packet data representative of the addresses of any font or alphanumerical images to be reproduced. If the answer for this step D04 is given in the affirmative, the step D04 is followed by a step D05 at which the packet data stored in the packet buffer register 248 is transferred to the bit-map data read-write control circuit 218. The bit-map data read-write control circuit 218 decodes the packet data thus received from the packet buffer register 248 and accesses the font memory unit 216 at the addresses designated by the packet data and fetches corresponding font data from the memory unit 216 to the bit-map RAM unit 214. While a data packet from the packet buffer register 248 is being thus processed by the bit-map data read-write control circuit 218, another data packet which may be stored in the packet buffer register 248 is prohibited by the step D02 from being output to the read-write control circuit 218.

Subsequently to the step D05, it is tested at step D06 whether or not the job control flag BMWRITE is of the logic "0" state indicating that the RAM unit 214 has no data stored therein and is thus ready to accept any data to be stored therein. If it is found at this step D06 that the flag BMWRITE is of the logic "0" state, the flag BMWRITE is set to logic "1" state as at step D07 and the central processing unit 234 reverts to the initial step D01.

The data stored in the packet buffer register 248 may consist of control data packets each consisting of data in accordance with which the font or alphanumerical image is to be reproduced. If it is found at the step D04 that the data stored in the packet buffer register 248 consists of such control data, the step D04 is followed by a step D08 at which is is queried whether or not the control data stored in the packet buffer register 248 consists of a signal JOB START of logic "1" state which may be included in the job control data. The signal JOB START is to be used for the grouping of pages and, if it is found that the control data stored in the packet buffer register 248 consists of such a signal, the signal is transferred to the interface control circuit 222 as at step D09. If it is found at the step D08 that the control data stored in the packet buffer register 248 consists of data other than the signal JOB START, it is tested at step D10 whether or not the data stored in the packet buffer register 248 consists of other coded signals which are to be processed by the interface control circuit 222. Such coded signals include a signal dictating the number of the printed outputs to be produced for a page of original image information and a signal indicating the sheet storage cassette to be selected for use. If the answer for this step D10 is given in the affirmative, the step D10 is followed by a step D11 at which the data consisting of such coded signals is transferred to the bit-map data read-write control circuit 218.

If it is determined at step D10 that the data stored in the packet buffer register 248 contains no code signals to be processed in the interface control circuit 222, then it is tested at step D12 whether or not the data in question consists of the signal PAGE EJECT of logic "1" state which is indicative of the termination of the storage of image data into the bit-map RAM unit 214 and which is thus used for the pagination of printed outputs.

If it is found at the step D12 that the signal PAGE EJECT of logic "1" state is present, it is determined that the storage of the image data into the RAM unit 214 is complete so that the step D12 is followed by a step D13 at which the job control flag JOBACT is set to the logic "1" state indicating that the operation for producing the specified number of printed outputs for the given page of original image information is still in progress. The job control flag JOBACT thus set to the logic "1" state is effective to prohibit the bit-map data read-write control circuit 218 from writing data into the bit-map RAM unit 214 in the presence of the signal PAGE EJECT of logic "1" state. While the flag JOBACT is thus set to the logic "1" state at the step D13, the job control flag JOBEJT is also set to the logic "1" state indicative of a request for starting, printing operation. In response to this flag JOBEJT of the logic "1" state, the print engine control network 208 supplies a print command signal PRNCMD to the interface control circuit 222 which further receives as at step D14 a print start command signal requesting the print engine module 32 to start printing operation.

If it is determined at step D12 that the signal PAGE EJECT of logic "1" state is not contained in the data stored in the packet buffer register 248, then it is tested at step D15 whether or not the data in question contains any information regarding the size of the images to be reproduced. If it is found at the step D15 that such information is contained in the data stored in the packet buffer register 248, the mode of printing as loaded from the bit-map data read-write control circuit 218 into the bit-map RAM unit 214 is modified on the basis of the information as at step D16. The mode of printing thus modified includes the capacity of the bit-map RAM unit 214 to be allocated to each line of bits of a single font image.

Print Control Subroutine

Figure 17:
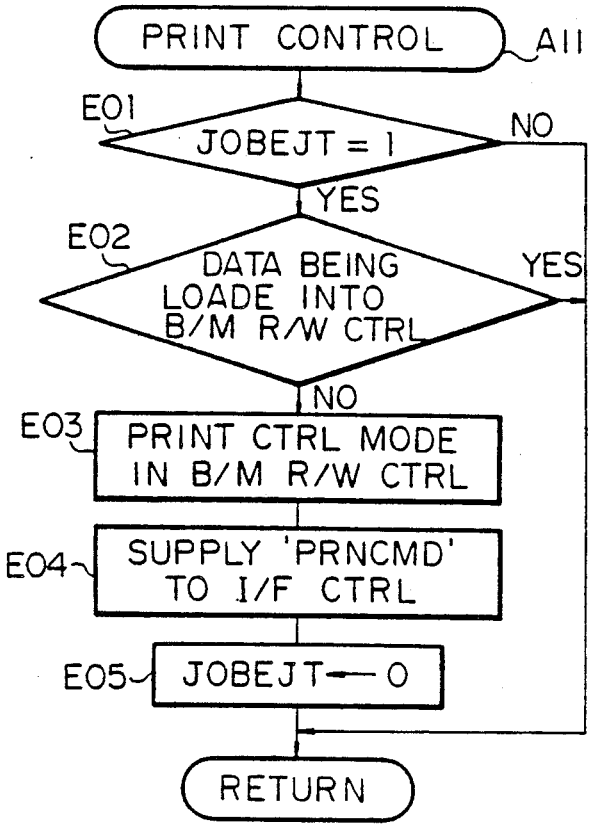
FIG. 17 is a flowchart showing the details of a print control subroutine included in the main routine program illustrated in FIG. 12.

FIG. 17 shows the details of the print control subroutine A11 included in the main routine program described with reference to FIG. 12. The print control subroutine A11 is executed to control the start of the printing operation on the basis of the job control flag such as the flag JOBEJT and in accordance with the status of the bit-map data read-write control circuit 218. Such a print control subroutine A11 starts with a decision step E01 to determine whether or not the job control flag JOBEJT is of the logic "1" state indicating that there currently is a request for another cycle of printing operation. As noted previously, the job control flag JOBEJT of the logic "1" state is effective to make the interface control circuit 222 ready to control the print engine module 32 to start for operation to produce a specified number of printed outputs possibly for a new page of original image information.

If it is found at the step E01 that there is a request for another cycle of printing operation in the presence of the job control flag JOBEJT of the logic "1", it is further queried whether or not the bit-map data read-write control circuit 218 is in operation for loading data into the bit-map RAM unit 214. If it is found that this is the case, the printing operation can not be re-started but, if it is found at the step E02 that the bit-map data read-write control circuit 218 is currently not in operation, the step E02 is followed by a step E03 at which a print control mode is established in the bit-map data read-write control circuit 218. Subsequently to the step E03, the print command signal PRNCMD is supplied to the interface control circuit 222 as at step E04 and, thereupon, the job control flag JOBEJT is reset to the logic "0" as at step E05.

Data Load Interrupt Subroutine

Figure 18:
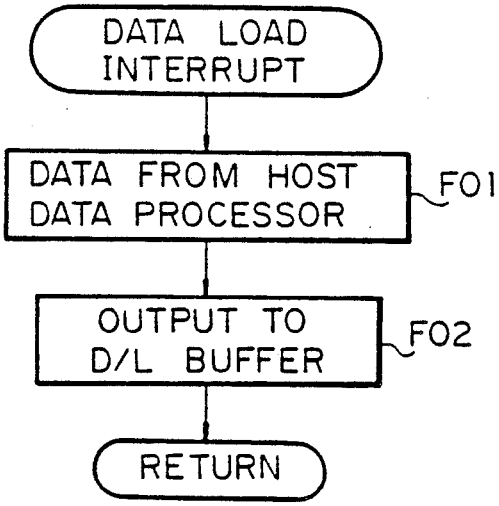
FIG. 18 is a flowchart showing the details of a data load interrupt subroutine which may be further included in the main routine program illustrated in FIG. 12.

In FIG. 18 is shown a data load interrupt subroutine which is executed to control the loading of data through the data input interface section 232 into the data latch buffer register 246 of the system RAM unit 236 (FIG. 10). Thus, the data load interrupt subroutine includes a step F01 at which data is supplied from the host data processor unit 202. At a subsequent step F02, the data thus supplied from the host data processor unit 202 is transferred through the data input interface section 232 to the data latch buffer register 246. The data is then re-formulated into packets and the resultant packet data is transferred to the packet buffer register 248 as noted previously for further transfer to the bit-map data read-write control circuit 218. If the time required for the processing of data is of no serious problem, the data loaded into the data latch buffer 246 may be transferred directly to the bit-map data read-write control circuit 218 without being reformulated into packet form.

Image Size Check Subroutine

Figure 19:
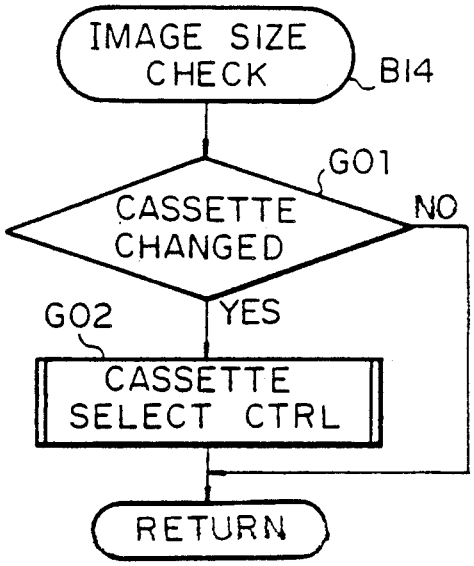
FIG. 19 is a flowchart showing the details of an image size check subroutine included in the data processing subroutine illustrated in FIG. 13.

FIG. 19 shows the image print size check subroutine B14 included in the data processing subroutine A08 described with reference to FIG. 13. The image print size check subroutine B14 is executed primarily to see if a new sheet storage cassette has been selected and if, there is a new sheet storage cassette selected, the size to which the images are to be reproduced is acceptable for the size of the print sheets P to be supplied from the newly selected sheet storage cassette.

Such an image print size check subroutine B14 is executed before the printing for a new page of original image information is to be started and includes a decision step G01 to check into the information supplied from the interface control circuit 222 to see whether or not there has been a request for change of the sheet storage cassette to be used for the printing for the new page. If it is found at this step G01 that there has been such a request, the step G01 is followed by a cassette select control subroutine G02 at which the sheet storage cassette is exchanged for the newly selected one. The details of the cassette select control subroutine G02 will be hereinafter described with reference to FIG. 20.

Cassette Select Control Subroutine

Figure 20:
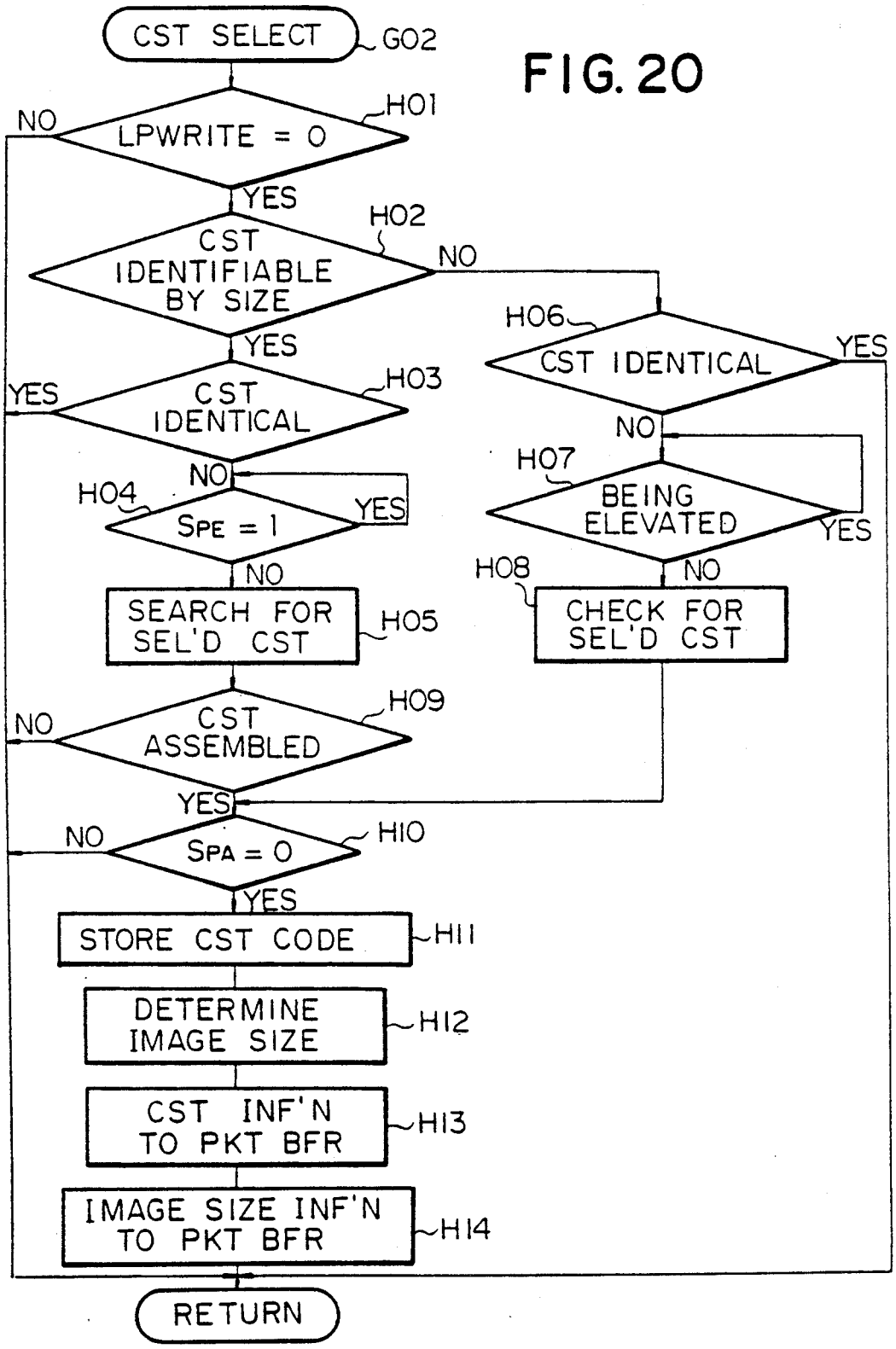
FIG. 20 is a flowchart showing the details of the cassette select control subroutine included in the image size check subroutine illustrated in FIG. 19.

Referring to FIG. 20, the cassette select control subroutine G02 included in the image print size check subroutine B14 as above described starts with a step H01 to confirm whether or not the job control flag LPWRITE is reset to logic "0" state. If it is found at the step H01 that the flag LPWRITE is of the logic "0" state indicating that there is still no data to be re-formulated in the data latch buffer register 246, it is then determined at step H02 whether the sheet storage cassettes **38*a*, 38*b* and 38*c* which may be provided in the sheet supply module 34 are identifiable depending on the sizes of the print sheets P respectively stored therein or on the positions which the sheet storage cassettes 38*a*, 38*b* and 38*c* respectively have within the sheet supply module 34. Such decision is made on the basis of the nature of the signals $S_{CP}$ produced by the cassette sensor 128 associated with each of the sheet storage cassettes 38*a*, 38*b* and 38*c* as previously described with reference to FIGS. 4 to 6**.

If it is determined at the step H02 that the sheet storage cassettes **38*a*, 38*b* and 38*c* are identifiable depending on the sizes of the print sheets P respectively stored therein, it is further tested at step H03 whether or not the sheet storage cassette found to be newly selected at step G01 of the image print size check subroutine B14 is identical with the sheet storage cassette which has been selected and in use. If the answer for this step H03 is given in the negative, it is tested at step H04 whether or not the stock of print sheets P in the newly selected sheet storage cassette is being currently elevated within the sheet storage cassette. This decision is made depending on whether the signal $S_{PE}$ supplied from the first photoelectric transducer 136 associated with the newly selected sheet storage cassette 38*a*, 38*b* or 38*c* is of the logic "1" or "0" state. When it is confirmed at the step H04 that the stock of the print sheets P in the newly selected cassette has been elevated and is now at rest, the particular cassette is searched out of the list of the sheet storage cassettes 38*a*, 38*b* and 38*c* memorized in the system RAM unit 236 as at step H05**.

On the other hand, if it is determined at the step H02 that the sheet storage cassettes **38*a*, 38*b* and 38*c* are identifiable depending on the positions which the sheet storage cassettes respectively have within the sheet supply module 34, it is also tested at step H06 whether or not the sheet storage cassette found to be newly selected at step G01 of the image print size check subroutine B14 is identical with the sheet storage cassette which has been selected and in use. If it is found at the step H06 that the newly selected sheet storage cassette is not identical with the sheet storage cassette which has been in use, it is tested at step H07 whether or not the stock of print sheets P stored in the newly selected sheet storage cassette is being currently elevated within the cassette. When it is confirmed at the step H07 that the newly selected cassette has been elevated and is now at rest, it is ascertained at step H08 that the particular cassette is installed in the sheet supply module 34. The decision of the step H07 is also made depending on whether the signal $S_{PE}$ supplied from the photoelectric transducer 136 associated with the newly selected sheet storage cassette 38*a*, 38*b* or 38*c*** is of the logic "1" or "0" state.

Subsequently to the step H08 or when it is found at step H09 subsequent to step H05 that the newly selected cassette is located in the list of the sheet storage cassettes **38*a*, 38*b* and 38*c* memorized in the system RAM unit 236, it is further checked at step H10 whether or not there is a stock of print sheets P stored in the particular sheet storage cassette. This decision of the step H10 is made depending on whether the signal $S_{PA}$ supplied from the second photoelectric transducer 138 associated with the newly selected sheet storage cassette 38*a*, 38*b* or 38*c* is of the logic "1" or "0" state. When it is found at the step H11 that there is a stock of print sheets P stored in the newly selected sheet storage cassette, the coded identification signal allocated to the particular cassette is memorized into the RAM unit 236 at step H11 and the image print size adequate for the size of the print sheets P stored in the selected sheet storage cassette is determined at step H12. The data specifying the newly selected sheet storage cassette and the image print size determined for the particular sheet storage cassette is re-formulated into packets and is loaded into the packet buffer register 248 at steps H13 and H14**, respectively.

Initial Paper Supply Cassette Select Subroutine

Figure 21:
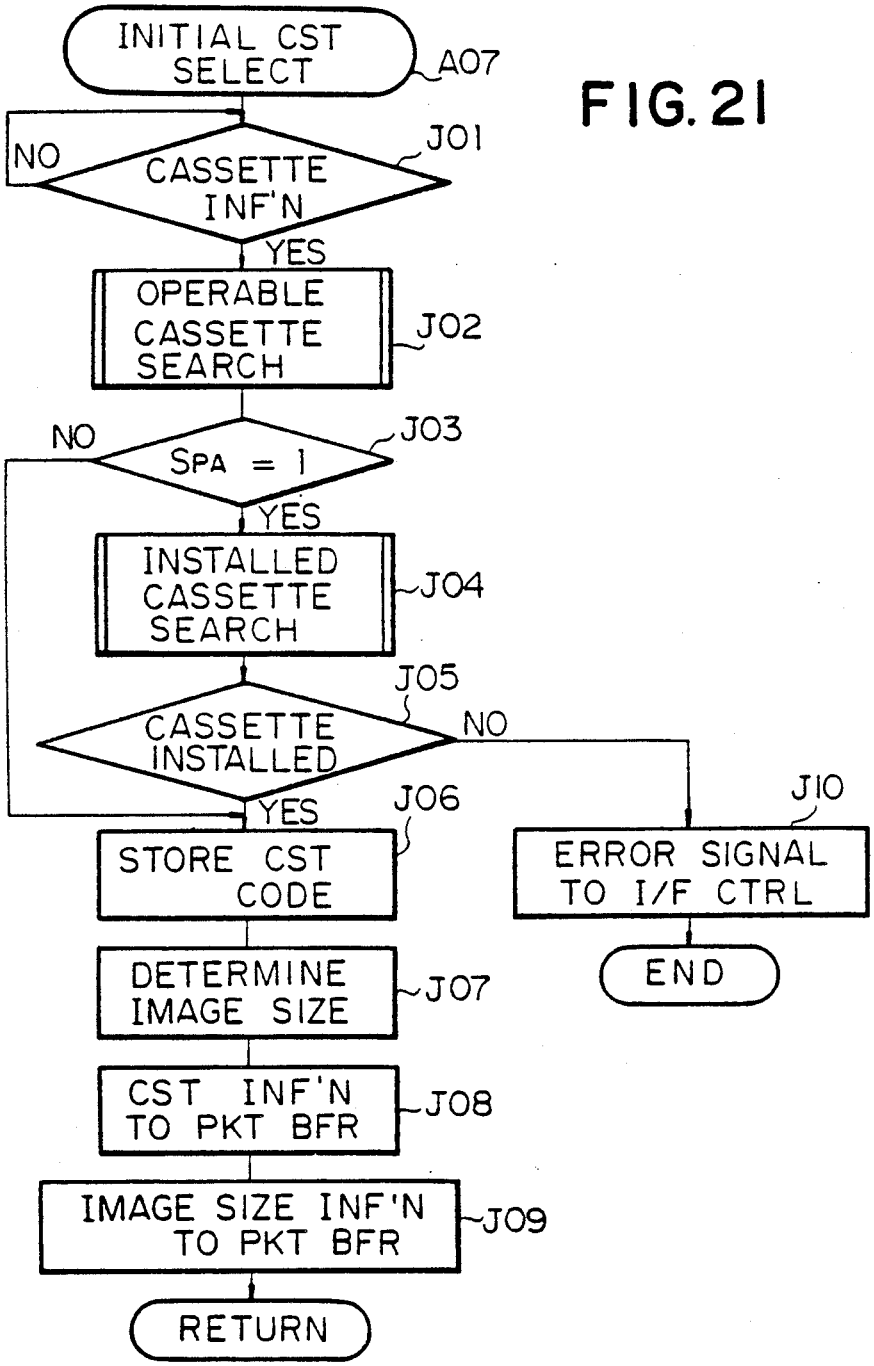
FIG. 21 is a flowchart showing the details of an initial paper storage cassette select control subroutine further included in the main routine program illustrated in FIG. 12.

FIG. 21 shows the details of the initial paper storage cassette select control subroutine A07 further included in the main routine program described with reference to FIG. 12. The initial paper storage cassette select control subroutine A07 is executed to initially select any of the sheet storage cassettes 38*a*, 38*b* and 38*c* available in the sheet supply module 34 responsive to any cassette select information supplied from the interface control circuit 222 of the print engine control network 208 and to the signals $S_{CP}$, $S_{PE}$ and $S_{PA}$ supplied from each of the cassette sensor arrangements 110*a* 110*b* and 110*c* (FIG. 3) respectively associated with the 38*a*, 38*b* and 38*c*. The information regarding the sheet storage cassette selected is necessitated for the re-formulation of the data loaded into the data latch buffer register 246, the calculation of the address at which font data is to be written into the bit-map RAM unit 214 from the bit-map data read-write control circuit 218, and the operation of the control circuit 218.

The initial paper storage cassette select control subroutine A07 starts with a step J01 to check if there is any information supplied from the interface control circuit 222 of the print engine control network 208 in respect of each of the sheet storage cassettes 38*a*, 38*b* and 38*c* which may be installed in the sheet supply module 34. The interface control circuit 222 of the print engine control network 208 is operative to supply such information as soon as the apparatus is initially switched in or each time any change is detected in the information after the apparatus is initially switched in. The information regarding the sheet storage cassettes 38*a*, 38*b* and 38*c* includes information indicating the presence or absence of each of the sheet storage cassettes, the size of the print sheets P stored in each sheet storage cassette or the identification code allocated to each sheet storage cassette, and the presence or absence of print sheets P stored in each of the sheet storage cassettes.

To the individual sheet storage cassettes 38*a*, 38*b* and 38*c* which may be installed in the sheet supply module 34 is assigned a predetermined order of priority which is herein assumed to be identical with this sequence of the sheet storage cassettes. After the apparatus is initially switched in, the lever plate 126 associated with each of the sheet storage cassettes 38*a*, 38*b* and 38*c* is brought into pressing engagement with the paper support plate 112 of each sheet storage cassette as previously described with reference to FIGS. 7A to 7D. Thus, the stocks of print sheets P, if stored the cassettes 38*a*, 38*b* and 38*c*, respectively, are caused to elevate successively in this sequence. After it is confirmed that the stock of print sheets P which may be stored in every one of the sheet storage cassettes installed has thus been elevated, it is checked if each of the cassettes 38*a*, 38*b* and 38*c* is really installed in the sheet supply module 34 and if there is a stock of print sheets P in each of the sheet storage cassettes detected to be installed. All these steps are followed in a cassette search subroutine J02, the details of which will be hereinafter described with reference to FIG. 22.

Upon execution of the cassette search subroutine J02, it is tested at step J03 whether or not one of the sheet storage cassettes 38*a*, 38*b* and 38*c* is empty with no stock of print sheets stored therein. This decision of the step J03 is made depending on whether or not the signal $S_{PA}$ supplied from the second photoelectric transducer 138 associated with the sheet storage cassette under consideration is of the logic "1" state. If it is found at the step J03 that there is no stock of print sheets in the particular one of the sheet storage cassettes 38*a*, 38*b* and 38*c*, the step J03 is followed by an installed cassette search subroutine J04 to make a search for another sheet storage cassette installed in the sheet supply module 34. This search is made on the basis of each of the signals $S_{CPa}$, $S_{CPb}$ and $S_{CPa}$, $S_{CPb}$ produced by the cassette sensors 128 associated the sheet storage cassettes 38*a*, 38*b* and 38*c*, respectively.

Subsequently to the installed cassette search subroutine J04, it is confirmed at step J05 whether or not there is another sheet storage cassette installed in the sheet supply module 34 and, when it is confirmed at the step J05 that this is the case, the coded identification signal allocated to the particular cassette is memorized into the RAM unit 236 at step J06 and the image print size adequate for the size of the print sheets P stored in the sheet storage cassette is determined at step J07. The image print size adequate for the size of the print sheets stored is determined from the table data stored in the RAM unit 236. The data specifying the newly selected sheet storage cassette and the image print size determined for the particular sheet storage cassette is re-formulated into packets and is loaded into the packet buffer register 248 at steps J08 and J09, respectively.

If it is found at the step J05 that there is no sheet storage cassette installed in the sheet supply module 34, it is assumed that there is any failure invited in each of the sheet storage cassettes 38*a*, 38*b* and 38*c* which may be provided in the sheet supply module 34 and, as such, a coded error signal is supplied to the interface control circuit 222 as at step J10 to terminate execution of the subroutine A07.

Cassette Search Subroutine

Figure 22:
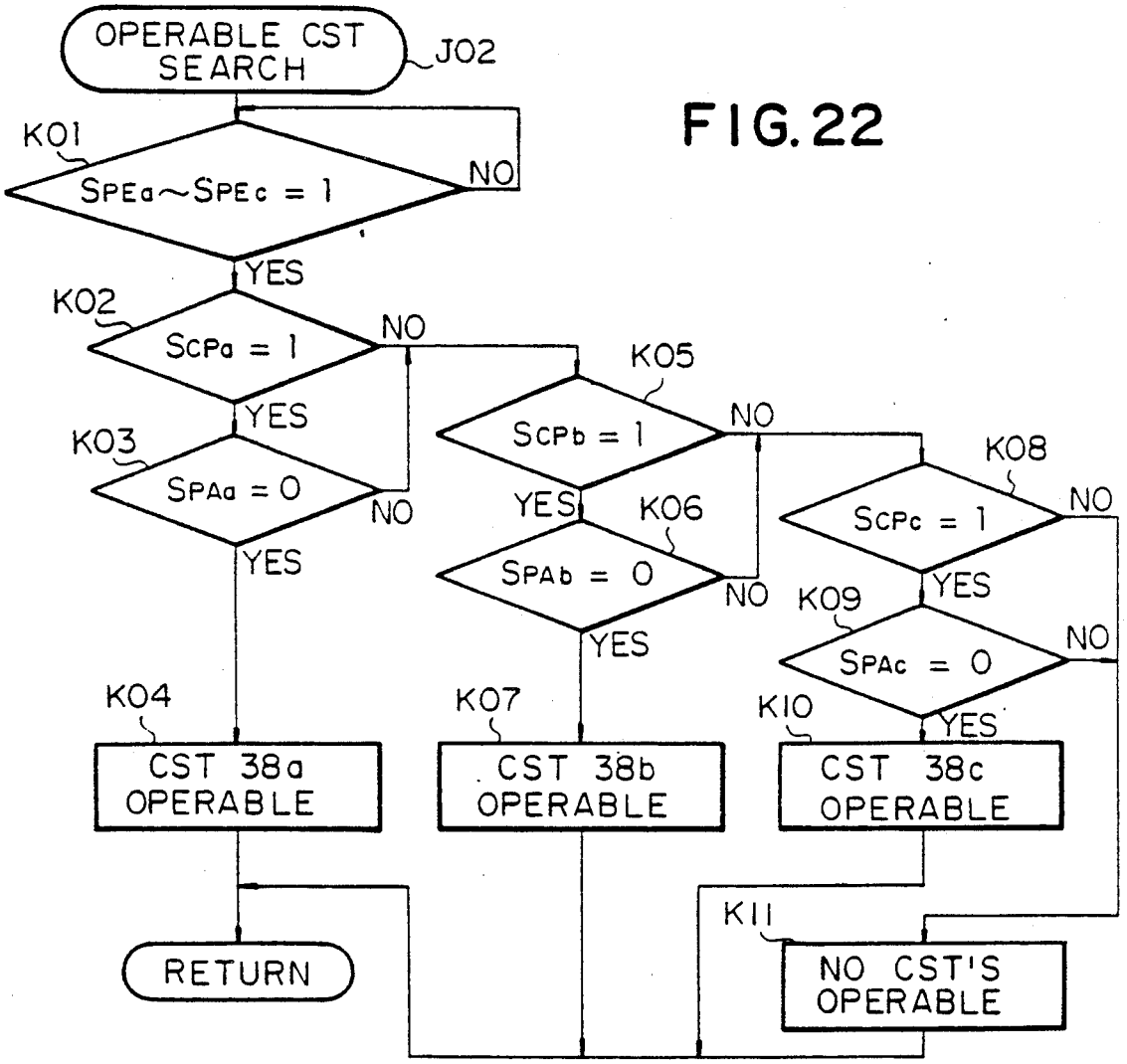
FIG. 22 is a flowchart showing the details of a cassette search subroutine included in the initial paper storage cassette select control subroutine illustrated in FIG. 21.

FIG. 22 shows the details of the cassette search subroutine J02 included in the initial paper storage cassette select control subroutine A07 hereinbefore described with reference to FIG. 21. The cassette search subroutine J02 starts with a decision step K01 to see if the stock of print sheets P which may be stored in every one of the sheet storage cassettes installed has been elevated. This test is made by confirming that each of the signals $S_{PEPa}$, $S_{PEb}$ and $S_{PEc}$ produced by the photoelectric transducers 138 provided in association with the sheet storage cassettes 38*a*, 38*b* and 38*c*, respectively, is of the logic "1" state. After this is confirmed, it is checked at step K02 if the uppermost sheet storage cassette 38*a* which has the first order of priority is installed in the sheet supply module 34. This test is made by confirming that the signal $S_{CPa}$ produced by the cassette sensor 128 provided in association with the sheet storage cassette 38*a* is of the logic "1" state. If it is found at the step K02 that the uppermost sheet storage cassette 38*a* is installed in the sheet supply module 34, it is further tested at step K03 whether or not there is a stock of print sheets P in the particular sheet storage cassette 38*a*. This test is made by confirming that the signal $S_{PAa}$ produced by the photoelectric transducer 136 provided in association with the sheet storage cassette 38*a* is of the logic "0" state. If it is found at the step K03 that there is a stock of print sheets P in the sheet storage cassette 38*a*, the coded identification signal allocated to the uppermost cassette 38*a* is passed to the central processing unit 234 for storage into the RAM unit 236 at step K04.

If it is found at the step K02 that the uppermost sheet storage cassette 38*a* is not installed in the sheet supply module 34 or, when it is found at the step K02 that the uppermost sheet storage cassette 38*a* is installed in the sheet supply module 34 but it is found at the step K03 that there is no stock of print sheets P in the sheet storage cassette 38*a*, the step K02 or K03 is followed by a step K05. At this step K05 is tested whether or not the intermediate sheet storage cassette 38*b* having the second order of priority is installed in the sheet supply module 34. This test is made by confirming that the signal $S_{CPb}$ produced by the cassette sensor 128 provided in association with the sheet storage cassette 38*b* is of the logic "1" state. If it is found at the step K05 that the intermediate sheet storage cassette 38*b* is installed in the sheet supply module 34, it is further tested at step K06 whether or not there is a stock of print sheets P in the particular sheet storage cassette 38*b*. This test is made by confirming that the signal $S_{PAb}$ produced by the photoelectric transducer 136 provided in association with the sheet storage cassette 38*b* is of the logic "0" state. If it is found at the step K06 that there is a stock of print sheets P in the sheet storage cassette 38*b*, the coded identification signal allocated to the intermediate cassette 38*b* is passed to the central processing unit 234 for storage into the RAM unit 236 at step K07.

If it is found at the step K05 that the intermediate sheet storage cassette 38*b* is not installed in the sheet supply module 34 or, when it is found at the step K05 that the intermediate sheet storage cassette 38*b* is installed in the sheet supply module 34 but it is found at the step K06 that there is no stock of print sheets P in the sheet storage cassette 38*b*, the step K05 or K06 is followed by a step K08. At this step K08 is tested whether or not the lowermost sheet storage cassette 38*c* having the third order of priority is installed in the sheet supply module 34. This test is made by confirming that the signal $S_{CPc}$ produced by the cassette sensor 128 provided in association with the sheet storage cassette 38*c* is of the logic "1" state. If it is found at the step K08 that the lowermost sheet storage cassette 38*c* is installed in the sheet supply module 34, it is further tested at step K09 whether or not there is a stock of print sheets P in the particular sheet storage cassette 38*c*. This test is made by confirming that the signal $S_{PAc}$ produced by the photoelectric transducer 136 provided in association with the sheet storage cassette 38*c* is of the logic "0" state. If it is found at the step K09 that there is a stock of print sheets P in the sheet storage cassette 38*c*, the coded identification signal allocated to the lowermost cassette 38*c* is passed to the central processing unit 234 for storage into the RAM unit 236 at step K10.

If it is found at the step K08 that the lowermost sheet storage cassette 38*c* is not installed in the sheet supply module 34 or, when it is found at the step K08 that the lowermost sheet storage cassette 38*c* is installed in the sheet supply module 34 but it is found at the step K09 that there is no stock of print sheets P in the sheet storage cassette 38*c*, the step K08 or K10 is followed by a step K11. At this step K11 is determined that there is no sheet storage cassette installed in the sheet supply module 34 or there is no sheet storage cassette having a stock of print sheets stored therein. Such information is supplied to the central processing unit 234. In this instance, it will be determined at the step J03 of the cassette select control subroutine A07 of FIG. 21 that there is no stock of print sheets in each of the sheet storage cassettes 38*a*, 38*b* and 38*c*. The installed cassette search subroutine J04 is thus executed subsequently to the step J03 to make a search for any sheet storage cassette installed in the sheet supply module 34. This search is made to see only if there exists any sheet storage cassette in the sheet supply module 34 in consideration of the fact that the current situation may have resulted from the absence of print sheet in a sheet storage cassette having a high order of priority or from the absence of a sheet storage cassette having a high order of priority but disassembled from the module 34 for any reason.

Installed Cassette Search Subroutine

Figure 23:
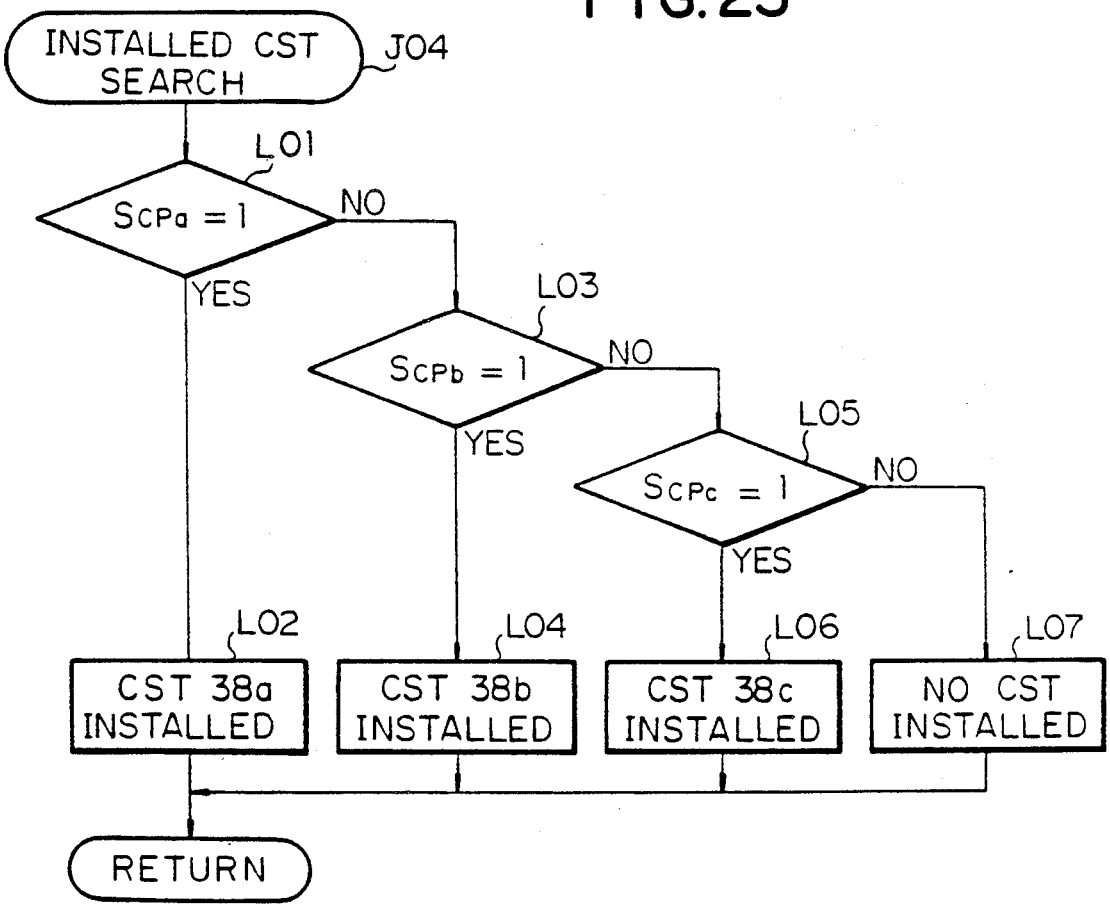
FIG. 23 is a flowchart showing the details of an installed cassette search subroutine also included in the initial paper storage cassette select control subroutine illustrated in 21.

FIG. 23 shows the details of such an installed cassette search subroutine J04 included in the initial paper storage cassette select control subroutine A07 described with reference to FIG. 21. The installed cassette search subroutine J04 starts with a step L01 to confirm whether or not the uppermost sheet storage cassette 38*a* is installed in the sheet supply module 34. This test is made by confirming that the signal $S_{CPa}$ produced by the cassette sensor 128 provided in association with the sheet storage cassette 38*a* is of the logic "1" state. If it is found at the step L01 that the uppermost sheet storage cassette 38*a* is installed in the sheet supply module 34, the coded identification signal allocated to the uppermost cassette 38*a* is passed to the central processing unit 234 for storage into the RAM unit 236 at step L02.

If it is found at the step L01 that the uppermost sheet storage cassette 38*a* is not installed in the sheet supply module 34, it is tested at step L03 whether or not the intermediate sheet storage cassette 38*b* having the second order of priority is installed in the sheet supply module 34. This test is made by confirming that the signal $S_{CPb}$ produced by the cassette sensor 128 provided in association with the sheet storage cassette 38*b* is of the logic "1" state. If it is found at the step L03 that the intermediate sheet storage cassette 38*b* is installed in the sheet supply module 34, the coded identification signal allocated to the intermediate cassette 38*b* is passed to the central processing unit 234 for storage into the RAM unit 236 at step L04.

If it is found at the step L03 that the intermediate sheet storage cassette 38*b* is not installed in the sheet supply module 34, it is tested at step L05 whether or not the lowermost sheet storage cassette 38*c* having the third order of priority is installed in the sheet supply module 34. This test is made by confirming that the signal $S_{CPc}$ produced by the cassette sensor 128 provided in association with the sheet storage cassette 38*c* is of the logic "1" state. If it is found at the step L05 that the lowermost sheet storage cassette 38*c* is installed in the sheet supply module 34, the coded identification signal allocated to the lowermost cassette 38*c* is passed to the central processing unit 234 for storage into the RAM unit 236 at step K10.

If it is found at the step L05 that the lowermost sheet storage cassette 38*c* is not installed in the sheet supply module 34, it is determined at step L07 that there is no sheet storage cassette installed in the sheet supply module 34 and such information is supplied to the central processing unit 234. Subsequently to the installed cassette search subroutine J04, it is confirmed at the step J05 of the initial paper storage cassette select control subroutine A07 of FIG. 21 whether or not there is a sheet storage cassette installed in the sheet supply module 34 and, when it is confirmed at the step J05 that this is the case, the steps J06 to J09 are followed successively as previously described. The initial paper storage cassette select control subroutine A07 has been assumed to be executed immediately after the apparatus is initially switched in, such a subroutine is executed also when the central processing unit 234 and associated peripheral devices are initialized by an instruction from the host microprocessor.

Figure 24A:
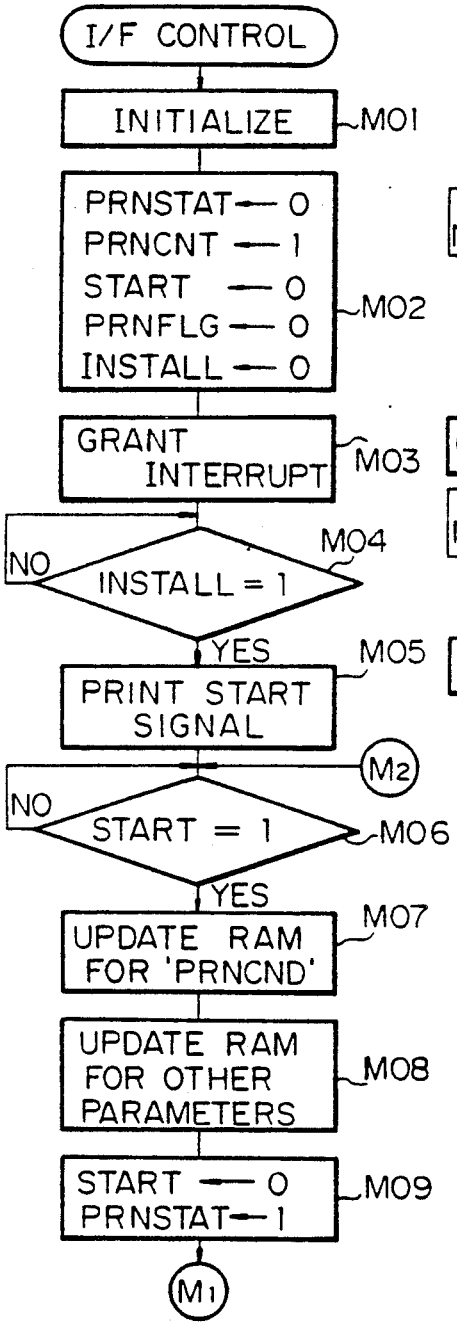
FIGS. 24A and 24B are flowcharts showing the details of a routine program to be executed by the interface control circuit included in the print engine control network of the system embodying the present invention.
Figure 24B:
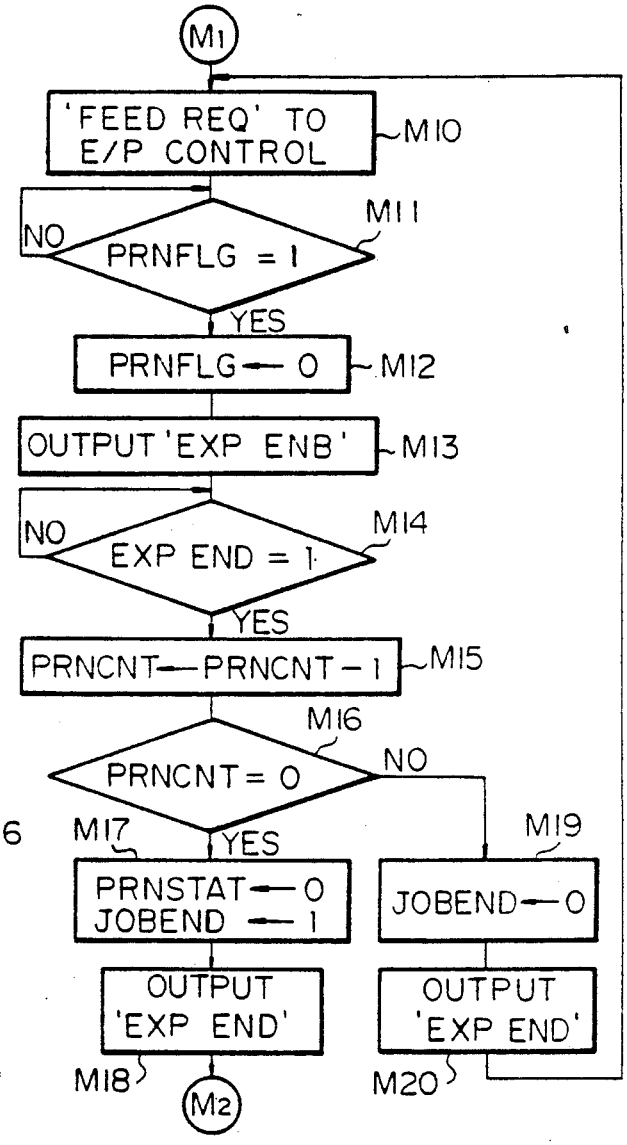

FIGS. 24A and 24B shows the details of a routine program to be executed by means of the interface control circuit 222 (FIG. 9) included in the print engine control network 208 of the system 100 embodying the present invention. The routine program starts with a step M01 for initializing the internal status of the interface control circuit 222 and thereupon proceeds to a step M02 at which various job control signals and flags used in the interface control circuit 222 are initialized each to logic "0" or "1" state. Such job control signals and flags are representative of various operational parameters used by the interface control circuit 222 and include signals and flags "PRNSTAT", "PRNCNT", "START", "PRNFLG", and "INSTALL".

Of these job control flags, the flag PRNSTAT when having a logic "1" state indicates that printing operation is currently in progress for a given page of original image information, the flag being initialized to logic "0" state.

The signal PRNCNT indicates the specified number of printed outputs to be produced for a given page of original image information, the signal being initialized to indicate a single printed output.

The command flag START when having a logic "1" state indicates that a print start signal is received from the bit-map control circuit 220 of the bit-map data processing network 206, the flag being initialized to logic "0" state.

The print request flag PRNFLG when having a logic "1" state indicates that the print command flag PRNCMD is received from the bit-map control circuit 220 of the bit-map data processing network 206, the flag being initialized to logic "0" state.

The control flag and INSTALL when having a logic "1" state indicates that the operation to inspect the initial conditions of the print engine module 32 is complete, the flag being initialized to logic "0" state.

After these job control signals and flags are thus initialized, two interrupt processes are granted at step M03. These interrupt processes consist of an interrupt process for receiving command signals from the bit-map control circuit 220 and a timed interrupt process for receiving signals from the control panel 40 (FIG. 2) and signals from the internal timers of the central processing unit 234. The interrupt handling routines for these two interrupts processes will be hereinafter described with reference to FIGS. 25 and FIGS. 26A and 26B, respectively.

Subsequently to the step M03, it is detected at step M04 whether or not the inspection of the initial conditions of the print engine module 32 is complete. This detection is on the basis of the flag INSTALL having the logic "1" state. When it is found at the step M04 that the inspection of the print engine module 32 is complete, a print start signal is transmitted to each of the paper supply control circuit 210 and sorter control circuit 212 and further to the electrophotographic process control circuit 224 and print head control circuit 226 of the print engine control network 208 by way of the bus B9 (FIG. 9).

After the print start signal is thus transmitted from the interface control circuit 222, the subroutine proceeds to a process loop which starts with a decision step M06 to confirm that the flag START is of the logic "1" state WITH the print start signal supplied from the bit-map control circuit 220. When it is confirmed that the flag START is of the logic "1" state, the contents of the bit-map RAM unit 214 is updated in accordance with the signal PRNCNT at step M07 and, in addition, various other control parameters which may have been memorized in the bit-map RAM unit 214 are also updated at step M08. The step M08 is followed by a step M09 at which the flag START is reset to logic "0" state and simultaneously the flag PRNSTAT is set to logic "1" state to indicate that printing operation is currently in progress.

The first cycle of printing operation is then performed with a command signal FEED REQ supplied to the electrophotographic process control circuit 224 of the print engine control network 208 (FIG. 9) as at step M10 (FIG. 24B) to request the control circuit 224 to supply a print sheet P from the selected sheet storage cassette. In response to the command signal FEED REQ, the electrophotographic process control circuit 224 initiates the electrophotographic process stage 228 into operation to start the supply of a print sheet and the electrophotographic processing. A print sheet P is now supplied from any one of the sheet storage cassettes **38*a*, 38*b* and 38*c* in the sheet supply module 34 and is guided to advance toward the photosensitive drum 72 by way of the guide rollers pairs 90 and 92 (FIG. 3). The print sheet P is then caused to detain immediately anterior to the timing roller pair 94 and, when it is thereafter confirmed at step M11 that the print request flag PRNFLG is of the logic "1" state with the print command signal PRNCMD received from the bit-map control circuit 220, the print request flag PRNFLG is reset to logic "0" state at step M12 and, thereupon, a flag EXP ENB to enable the print head control circuit 226. Optical scanning of the currently given page of original image information is now started under the control of the print head control circuit 226**.

When the first cycle of printing operation is complete, the flag EXP END indicative of the termination of the optical scanning operation is set to the logic "1" state. When this is confirmed at step M14, the interface control circuit 222 starts the operation to control the number of the printed outputs to be produced for the currently given page of original image information. For this purpose, the number of printed outputs as represented by the signal PRNCNT is decremented by one as at step M15 and, thereupon, it is checked at step M16 whether or not the signal PRNCNT indicates that there is no more printed outputs to be produced. If the answer for this step M16 is given in the affirmative, the step M16 is followed by a step M17 at which the flag PRNSTAT is reset to the logic "0" state to indicate that printing operation for the currently given page of original image information is complete and the job control flag JOBEND is set to the logic "1" state indicating that the printing operation for the page is terminated. At a step M18 subsequent to the step M17, the flag EXP END is set to the logic "1" state and is transmitted to the bit-map control circuit 220 to inform the circuit 220 that the optical scanning of the currently given page of image information is complete.

If it is found at the step M16 that the signal PRNCNT indicates that there is another printed output to be produced, the step M16 is followed by a step M19 at which the flag JOB END is reset to the logic "0" state to indicate that printing operation for the currently given page of original image information is incomplete. At subsequent step M20, the flag EXP END is set to the logic "1" state and is transmitted to the bit-map control circuit 220 to inform the circuit 220 that the optical scanning of the currently given page of image information is complete.

Figure 25:
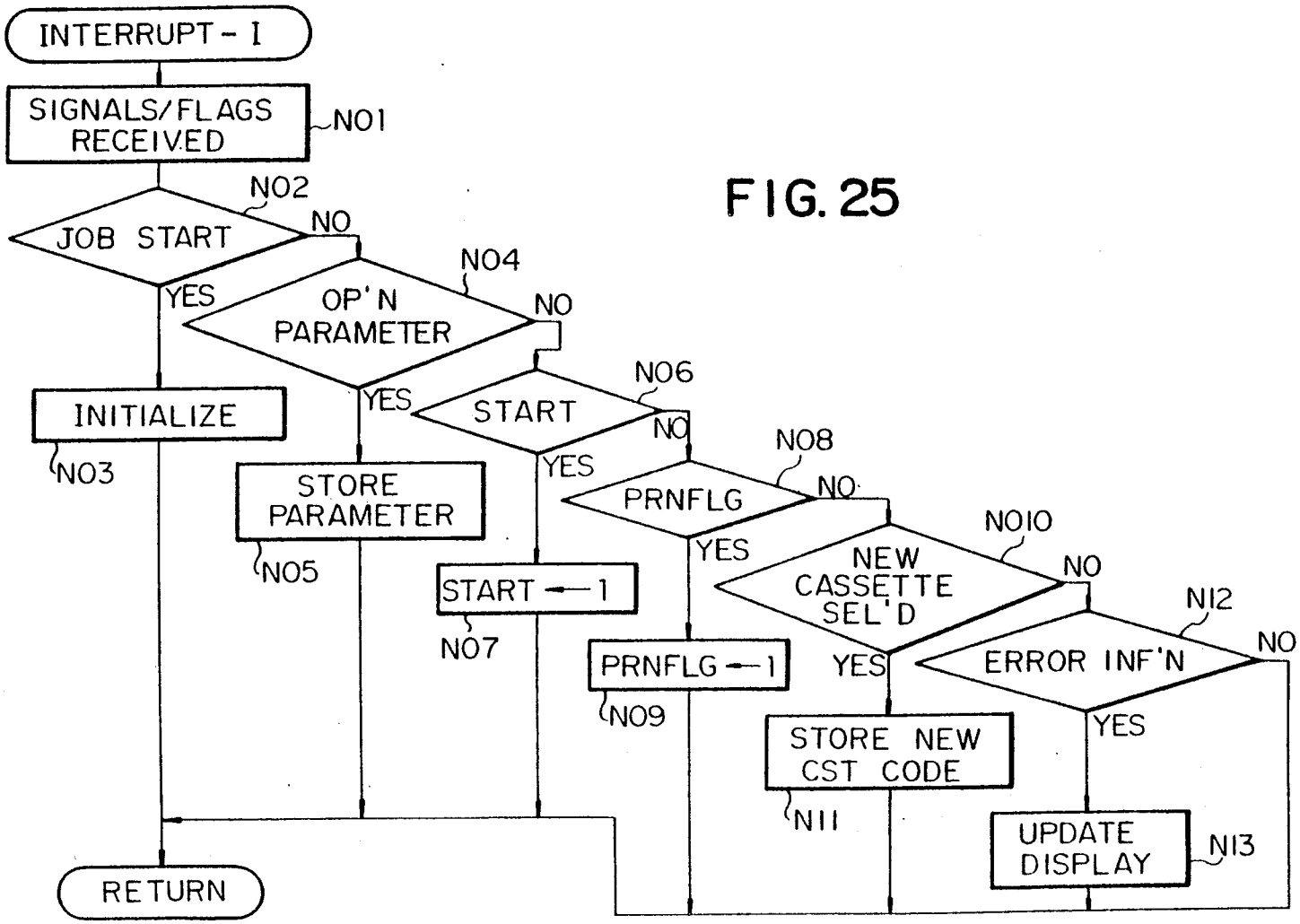
FIG. 25 is a flowchart showing the details of the interrupt handling routine for an interrupt process included in the routine program illustrated in FIGS. 24A and 24B.

FIG. 25 shows the details of the interrupt handling routine for one interrupt process included in the routine program described with reference to FIGS. 24A and 24B. The interrupt handling routine herein shown is executed for the purpose of receiving command signals from the bit-map control circuit 220. The command signals received from the bit-map control circuit 220 are not used in the control circuit 220 not for executing the instructions designated by the signals but for raising or lowering the flags to be used in the interface control circuit 222. Thus, the instructions designated by the signals received by the bit-map control circuit 220 are executed when such flags are detected during execution of the subroutine interface control subroutine described with reference to FIG. 24. This is for the purpose of performing the communications between the interface control circuit 222 and bit-map control circuit 220 in an asynchronous manner so that the process loop for performing printing operation may be composed of a minimum of steps.

The interrupt handling routine illustrated in FIG. 25 starts with a step N01 at which any command signal or flag is transmitted from the bit-map control circuit 220 to the interface control circuit 222. The step N01 is thus followed by a step N02 to test whether or not the command signal or flag consists of the flag JOB START of logic "1" state. The signal JOB START is to be used for the grouping of pages as previously noted and, if it is found that the signal or flag received by the interface control circuit 222 consists of such a signal, the contents of the bit-map RAM unit 214 is updated in accordance with the signal PRNCNT at step N03. If it is determined at step N04 that the command signal or flag received is any of other control parameters, the parameter is memorized in the bit-map RAM unit 214 at step N05. If it is found at step N05 that the command signal or flag received is the flag START, then the flag START is set to logic "1" state as at step N07 to indicate that printing operation is currently in progress. If it is determined at step N08 that the command signal or flag received is the print command signal PRNFLAG, the flag is set to logic "1" state as at step N09. If it is found at step N10 that the command signal or flag received is the information indicating that a new cassette is selected, then the corresponding data in the bit-map RAM unit 214 is updated accordingly at step N11. If it is determined at step N12 that the data received by the interface control circuit 222 consists of information indicating that there is any failure invited in any of the sheet storage cassettes 38*a*, 38*b* and 38*c* which may be provided in the sheet supply module 34, an error signal predominant over corresponding information to be displayed on the control panel 40 is updated at step N13.

Figure 26A:
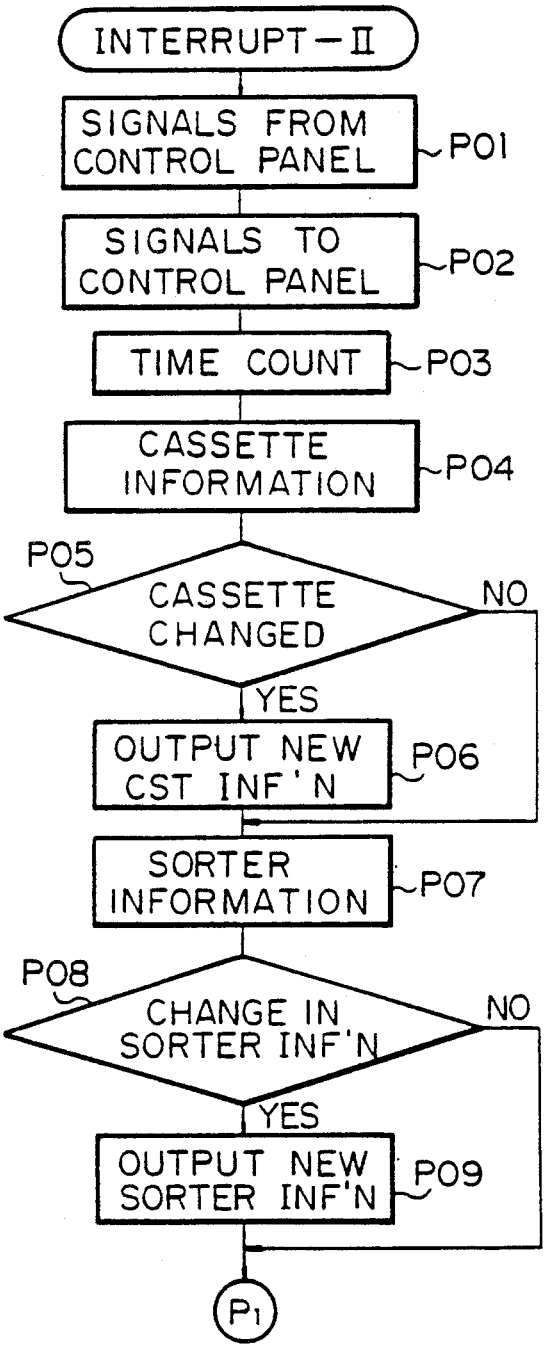
FIGS. 26A and 26B are flowcharts showing the details of the interrupt handling routine for another interrupt process included in the routine program illustrated in FIGS. 24A and 24B.
Figure 26B:
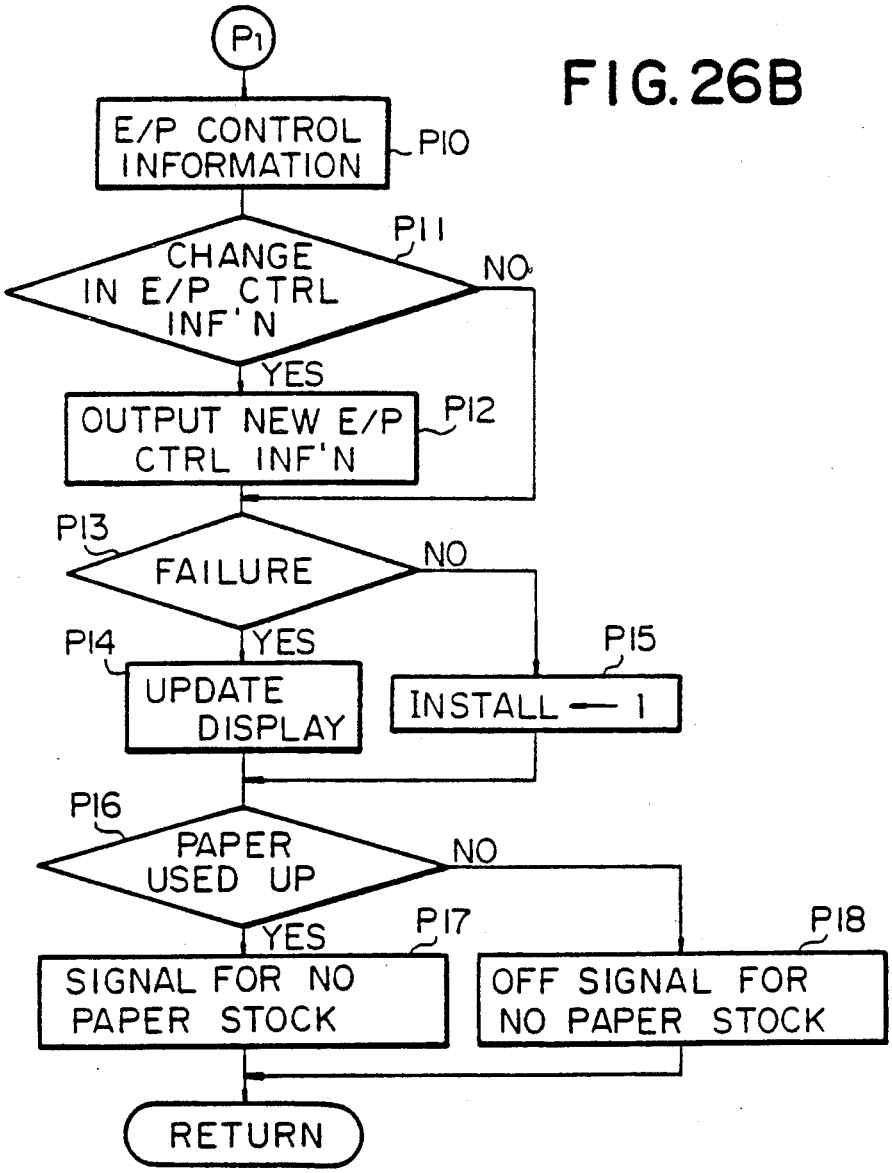

FIGS. 26A and 26B is a flowchart showing the details of an interrupt handling routines for the timed interrupt process further included in the routine program described with reference to in FIGS. 24A and 24B. The interrupt handling routine herein shown is executed for the purpose of receiving signals from the control panel 40 (FIG. 2) and signals from the internal timers of the central processing unit 234.

The interrupt handling routine illustrated in FIG. 26 starts with a step P01 at which the signals produced in the control panel 40 (FIG. 2) are processed. Furthermore, the signals to be supplied to the display and indicator elements of the control panel 40 are processed at step P02 and the time set by each of the timers used in the process loop of the interface control subroutine described with reference to FIGS. 24A and 24B is counted at step P03. The information regarding the sheet storage cassette selected in the sheet supply module 34 and the size of the print sheets P stored therein is checked at a step P04.

It is then tested at step P05 whether or not there has been a change in the information regarding the selected sheet storage cassette and if it is found that there is any change in the cassette information, the updated cassette information is transmitted to the bit-map control circuit 220 as at step P06. The bit-map control circuit 220 may then receive information regarding the current status of the print output sorter 36 as at step P07 and if it is detected at step P08 that there has been any change in the information thus received, the updated information is also transmitted to the bit-map control circuit 220 as at step P09.

The bit-map control circuit 220 may further receive information regarding the current status of the electrophotographic process control circuit 224 of the print engine control network 208 (FIG. 9) as at step P10. If it is detected at step P11 that there has been any change in the information thus received, the updated information is also transmitted to the bit-map control circuit 220 as at step P12. In addition, in the event any failure is found invited in the apparatus as detected at step P13, the bit-map control circuit 220 also receives the information indicative of the failure and may thus renew the indication on the control panel 40 if necessary as at step P14. In the absence of such a failure detected, the flag INSTALL is set to the logic "0" state at step P15 to indicate that the inspection of the print engine module 30 has terminated normally.

Subsequently to the step P14 or to the step P15, it is tested at step P16 whether or not the stock of print sheets P in the sheet storage cassette currently in use has been used up. If it is found that there is no stock of print sheets stored in the particular sheet storage cassette, information to such an effect is produced at step P17 and, if it is found that there is a stock of print sheets remaining in the particular sheet storage cassette, then information is produced accordingly at step P18.

In the embodiment of the present invention as has been hereinbefore described, the printer control system 200 is disabled from selecting any sheet storage cassette after a cassete is selected on the basis of an instruction transferred from the host data processor unit 202 to the printer control system 200. This is realized by the step B13 of the subroutine A08 described with reference to FIG. 14 and the steps C08 to C10 of the subroutine A09 described with reference to FIG. 15. If desired, however, an instruction to prohibit selection of a cassete may be transferred from the data processor unit 202 to the printer control system 200 independently of a cassette select instruction which may be transferred from the host data processor unit 202 to the control system 100. In this instance, the printer control system 200 is to set the flag DISINST to logic "1" state in response to such a prohibitive instruction from the host processor unit 202. Furthermore, the flag DISINST may be set to logic "1" state during printing operation of the apparatus 30 and reset to logic "0" state upon termination of the printing operation.

It has been assumed in the described embodiment of the present invention that, when a cassette is newly assembled to the sheet supply module 34, the printer control system 200 selects the particular cassette. This is however merely by way of example and, as such, a cassette may be selected through manipulation of, for example, a cassette select key or switch provided on the printer apparatus.

What is claimed is:

1. A printer apparatus comprising a) image forming means for forming a visible image on a print sheet, b) plurality of sheet supply means each comprising a sheet storage cassette detachably incorporated therein, c) data supply means for supplying data including image data relating to the image to be formed by said image forming means and control data designating one of said sheet supply means, d) detecting means for detecting whether the sheet storage cassette is present in each of said sheet supply means, e) first selecting means responsive to information from said detecting means for selecting one of the sheet supply means, the presence of which has been detected by said detecting means, f) second selecting means responsive to said control data for selecting the sheet supply means designated by the control data, and g) control means for prohibiting operation of said first selecting means after any of said sheet supply means has been selected by said second selecting means.

2. A printer apparatus comprising a) a printer module comprising image forming means for forming a visible image on a print sheet, a plurality of sheet supply means each for supplying a print sheet to said image forming means, signal generating means for generating a designation signal designating one of said sheet supply means, and first selecting means responsive to said designation signal for selecting one of said sheet supply means designated by said designation signal, b) data supply means provided independently of said printer module and operative to supply to said printer module data including image data relating to the image to be formed by said image forming means and control data designating one of said sheet supply means, said printer module further comprising c) second selecting means responsive to said control data for selecting the sheet supply means designated by the control data, and d) control means for prohibiting operation of said first selecting means after any of said sheet supply means has been selected by said second selecting means.

3. A printer apparatus comprising a) a printer module comprising image forming means operative to form a visible image on a print sheet, a plurality of sheet supply means each for supplying a print sheet to said image forming means, signal generating means for generating a designation signal designating one of said sheet supply means, and first selecting means responsive to said designation signal for selecting one of said sheet supply means designated by said designation signal, b) data supply means provided independently of said printer module and operative to supply to said printer module data including image data relating to the image to be formed by said image forming means and control data designating one of said sheet supply means, said printer module further comprising c) second selecting means responsive to said control data for selecting the sheet supply means designated by the control data, and d) control means for prohibiting operation of said first selecting means when said image forming means is in operation.

4. A printer apparatus comprising a) image forming means for forming a visible image on print sheet, b) a plurality of sheet supply means each comprising a sheet storage cassette detachably incorporated therein, c) detecting means for detecting whether the sheet storage cassette is present in each of said sheet supply means, d) first selecting means responsive to information from said detecting means for selecting one of the sheet supply means, the presence of which has been detected by said detecting means, e) data supply means for supplying data including image data relating to the image to be formed by said image forming means, first control data designated one of said sheet supply means, and second control data effective to disabling said first selecting means, f) second selecting means responsive to said first control data for selecting the sheet supply means designated by the control data, and g) control means responsive to said second control data for disabling said first selecting means.

5. A printer apparatus comprising a) a printer module comprising image forming means for forming a visible image on a print sheet, a plurality of sheet supply means each for supplying a print sheet to said image forming means, signal generating means for generating a designation signal designating one of said sheet supply means, and first selecting means responsive to said designation signal for selecting one of said sheet supply means designated by said designation signal, b) data supply means provided independently of said printer module and operative to supply to said printer module data including image data relating to the image to be formed by said image forming means, first control data designating one of said sheet supply means, and second control data effective to disabling said first selecting means, said printer module further comprising c) second selecting means responsive to said first control data for selecting the sheet supply means designated by the control data, and d) control means responsive to said second control data for disabling said first selecting means.

6. A printer apparatus comprising a) a printer module comprising image forming means for forming a visible image on a print sheet, a plurality of sheet supply means each for supplying a print sheet to said image forming means, and first selecting means for selecting one of said sheet supply means, b) data supply means provided independently of said printer module and operative to supply to said printer module data including image data relating to the image to be formed by said image forming means and control data designating one of said sheet supply means, said printer module further comprising c) second selecting means responsive to said control data for selecting the sheet supply means designated by the control data, and d) control means for prohibiting operation of said first selecting means when said image forming means is in operation.

7. An image forming apparatus comprising a) means for forming a visible image on a print sheet, b) a plurality of sheet supply means each comprising a sheet storage cassette detachably incorporated therein, c) detecting means for detecting the attaching operation of the sheet storage cassette in each of said sheet supply means, d) first selecting means responsive to said detecting means for automatically selecting the sheet supply means the attaching operation of which has been detected by said detecting means, e) signal generating means for generating a designation signal which designates one of said sheet supply means, f) second selecting means responsive to said designation signal for selecting the sheet supply means designated by the signal, and g) control means for prohibiting operation of said first selecting means after any of said sheet supply means has been selected by said second selecting means.

8. A printer apparatus including a plurality of sheet feeding means each comprising a sheet storage cassette detachably incorporated therein, first selecting means for selecting one of said sheet feeding means and image forming means for forming a visible image on a copy sheet fed from the selected one of said sheet feeding means, said image forming means forming the visible image based on an electrical image data supplied from data supply means, said selecting means selecting one of said sheet feeding means in response to a selection data supplied from the data supply means, said printer apparatus comprising a) detecting means for detecting the attaching operation of the sheet storage cassette in each of said supply means, b) second selecting means responsive to said detecting means for selecting the sheet supply means the attaching operation of which has been detected by said detecting means, and c) control means responsive to a special signal supplied from said data supply means for prohibiting operation of said second selecting means.

9. A printer apparatus including a plurality of sheet feeding means each comprising a sheet storage cassette detachably incorporated therein, first selecting means for selecting one of said sheet feeding means and image forming means for forming a visible image on a copy sheet fed from the selected one of said sheet feeding means, said image forming means forming the visible image based on an electrical image data supplied from data supply means, said selecting means selecting one of said sheet feeding means in response to a selection data supplied from the data supply means, said printer apparatus comprising a) detecting means for detecting the attaching operation of the sheet storage cassette in each of said supply means, b) second selecting means responsive to said detecting means for selecting the sheet supply means the attaching operation of which has been detected by said detecting means, and c) control means for prohibiting operation of said second selecting means after any of said sheet supply means has been selected by said first selecting means.

10. A printer apparatus including a plurality of sheet feeding means each comprising a sheet storage cassette detachably incorporated therein, first selecting means for selecting one of said sheet feeding means, and image forming means for forming a visible image on a copy sheet fed from the selected one of said sheet feeding means, said image forming means forming the visible image based on an electrical image data supplied from data supply means, said selecting means selecting one of said sheet feeding means in response to a selection data supplied from the data supply means, said printer apparatus comprising a) signal generating means for generating a signal designating one of said sheet supply means, b) second selecting means responsive to said designating signal for selecting the sheet supply means designated by said signal, and c) control means for prohibiting operation of said second selecting means when said image forming means is in operation.

11. An image forming apparatus comprising:

a) means for forming a visible image on a print sheet;

b) a plurality of sheet supply means each comprising a sheet storage cassette detachably incorporated therein;

c) detecting means for detecting the attaching operation of the sheet storage cassette in each of said sheet supply means and generating a first signal;

d) means for generating a second signal independent from said first signal;

e) automatic selecting means responsive to said first signal for automatically selecting any one of the sheet supply means for which the attaching operation has been detected by said detecting means; and f) control means responsive to said second signal for disabling said automatic selecting means irrespective of said first signal.

12. The image forming apparatus as claimed in claim 11, further comprising a controller, and wherein said second signal is supplied from the controller which is separate from said image forming apparatus.

13. The image forming apparatus as claimed in claim 12, wherein said controller supplies image data, and said image forming means forms a visible image on a print sheet in accordance with said image data.

* * * * *